United States Patent [19]

Watanabe

[11] 4,241,925

[45] Dec. 30, 1980

[54] TOY HAVING PROJECTILE MOVABLE IN BOTH COORDINATES OF A PLANE

[75] Inventor: Hiroyuki Watanabe, Tokyo, Japan

[73] Assignee: Tomy Kogyo Co., Inc., Tokyo, Japan

[21] Appl. No.: 14,056

[22] Filed: Feb. 22, 1979

Related U.S. Application Data

[63] Continuation-in-part of Ser. No. 971,646, Dec. 21, 1978.

[30] Foreign Application Priority Data

Oct. 16, 1978 [JP] Japan ..... 53-127022

[51] Int. Cl.[3] ..... A63F 9/00

[52] U.S. Cl. ..... 273/316; 273/1 E

[58] Field of Search ..... 273/101.2, 85 R, 85 G, 273/1 E, 316; 35/25

[56] References Cited

U.S. PATENT DOCUMENTS

| | | | |
|---|---|---|---|
| 2,310,084 | 2/1943 | Hooker et al. | 273/101.1 |
| 2,943,855 | 7/1960 | Javna et al. | |
| 3,012,779 | 12/1961 | Friedman | 35/25 UX |
| 3,171,215 | 3/1965 | Glass et al. | |
| 3,193,946 | 7/1965 | Patuano . | |
| 3,270,439 | 9/1966 | Davenport . | |
| 3,568,332 | 3/1971 | Koci et al. | |
| 3,819,178 | 6/1974 | Ochi . | |
| 3,843,128 | 10/1974 | Licitis et al. | 273/101.2 |
| 4,006,897 | 2/1977 | Llorens | 273/85 R |
| 4,006,899 | 2/1977 | Lohr et al. | |
| 4,014,544 | 3/1977 | Kimura . | |

FOREIGN PATENT DOCUMENTS

| | | | |
|---|---|---|---|
| 900104 | 7/1962 | United Kingdom | 273/101.2 |

*Primary Examiner*—Anton O. Oechsle

*Attorney, Agent, or Firm*—Edward D. O'Brian

[57] ABSTRACT

A toy game has a series of objects mounted on at least one endless belt such that the objects continuously orbit within the toy and are alternately exposed through a viewing window. A projectile is also mounted within the toy and can be seen through the viewing window. The projectile is capable of moving in a direction perpendicular to the orbit of the objects upon depressing a projectile launch button. Further the projectile is capable of moving in a direction parallel to the orbit of the objects under direct response to an operator controlled guidance wheel. When the projectile and an object are in a position wherein they occupy the same space as defined by x and y coordinates but not necessarily z coordinates of an x, y, z coordinate system the projectile is deemed to have scored a hit on the object. When thus hit the object motion ceases for an interval of time and the operator of the toy accumulates a number of points on a scoring device corresponding in value to the object hit. The toy also includes a timer to allow the skill of the operator of the toy to be judged by how many points the operator of the toy can accumulate in a fixed amount of time.

30 Claims, 19 Drawing Figures

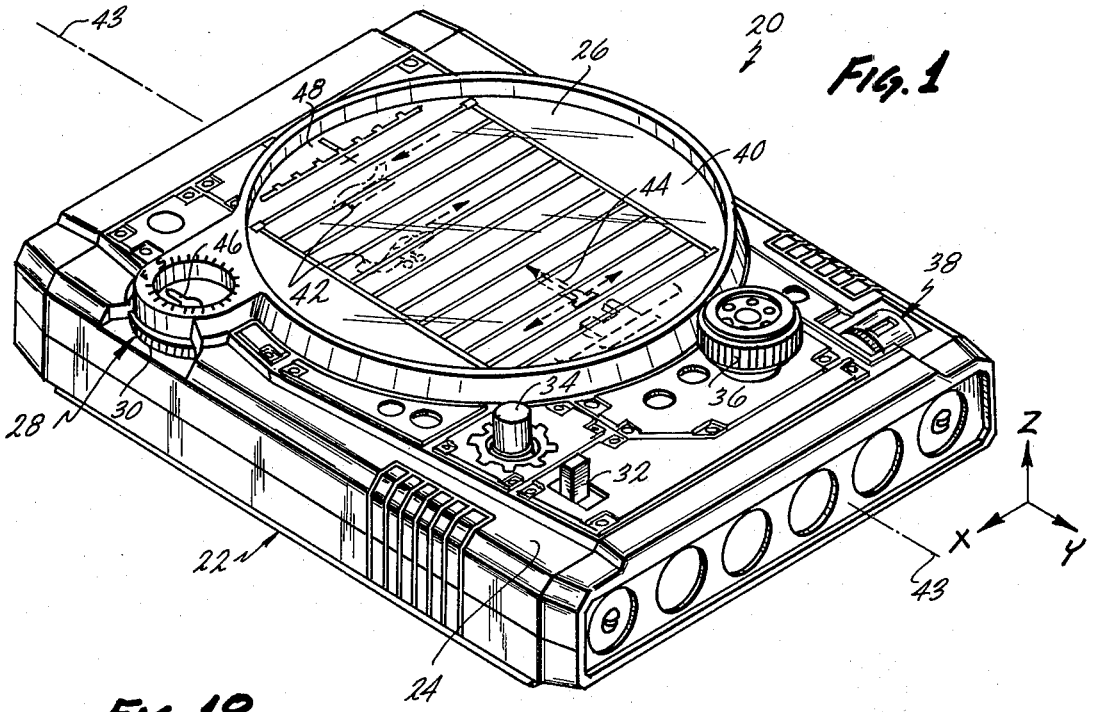
FIG. 1
FIG. 18
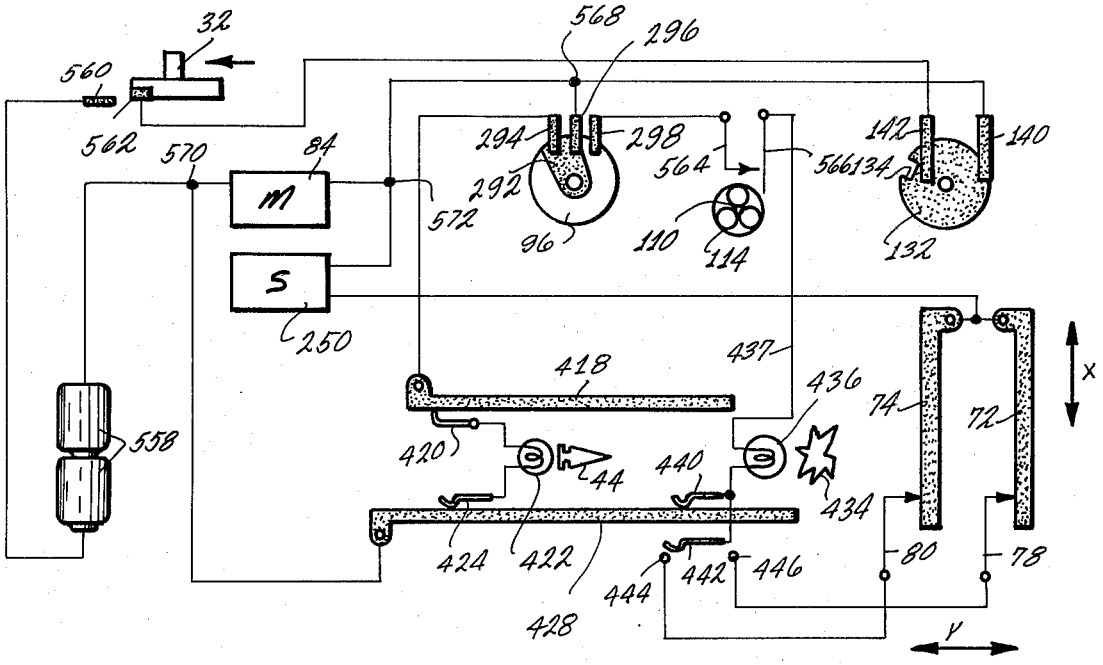

FIG. 4
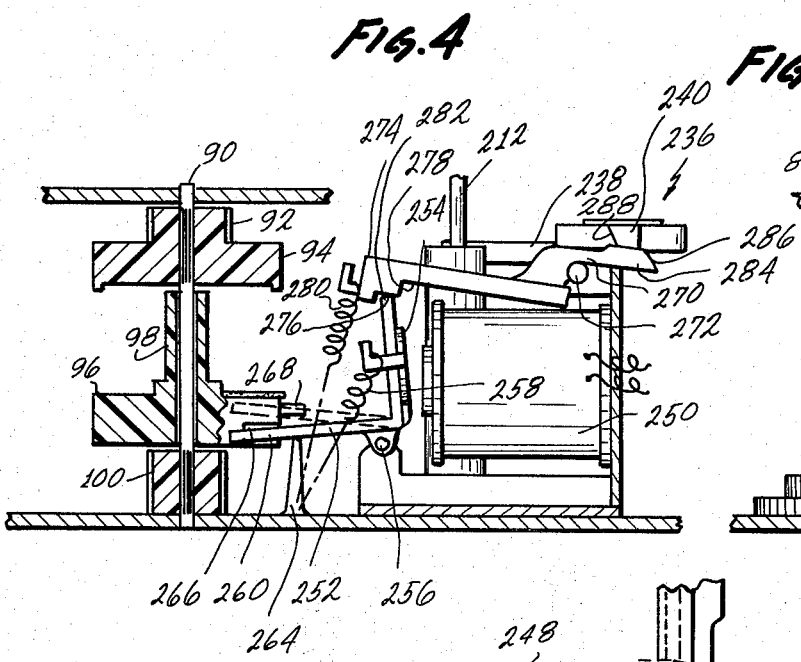
FIG. 6
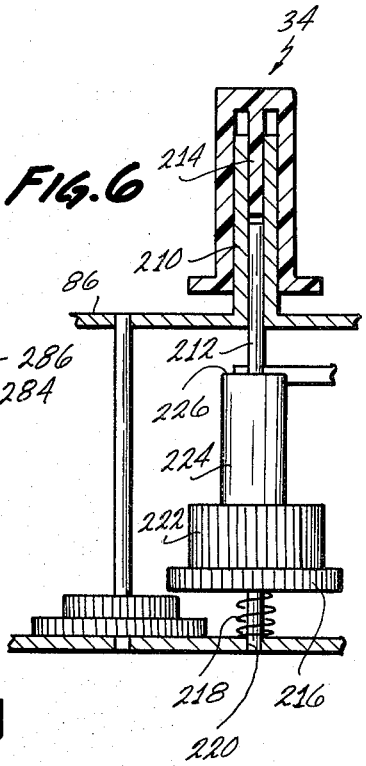
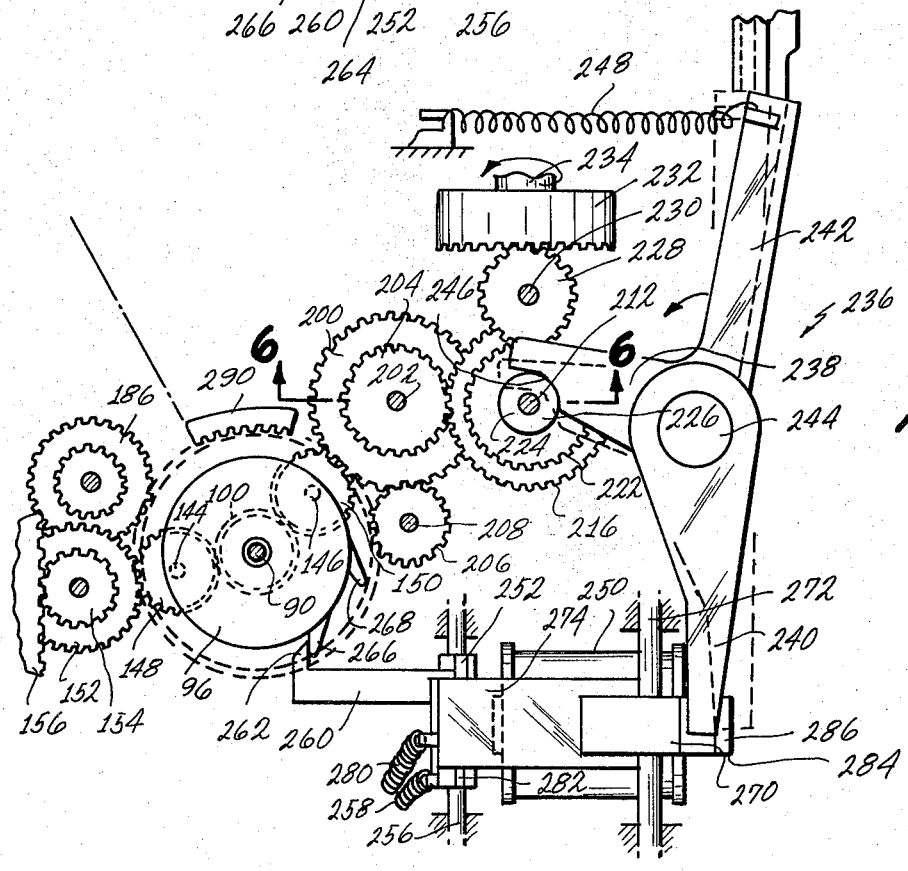
FIG. 5

426
444
442
428
52
424
50
432
434
430
42
74
76
72
362
358
80
356
78
82
364
360
354
366

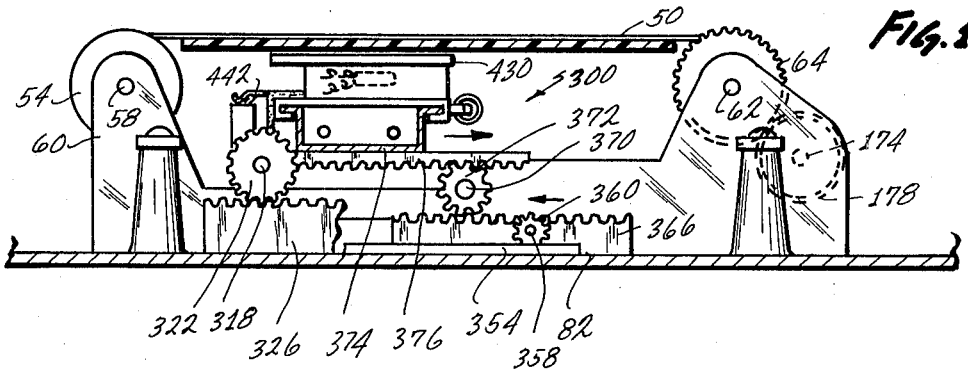
FIG. 10
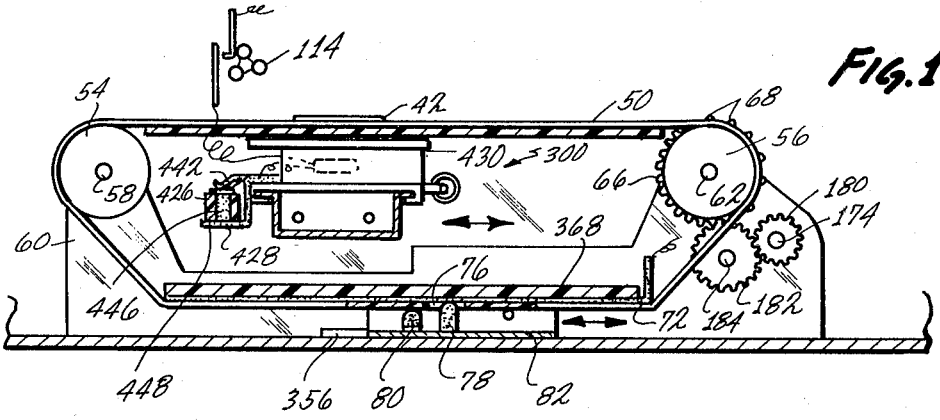
FIG. 11
FIG. 16
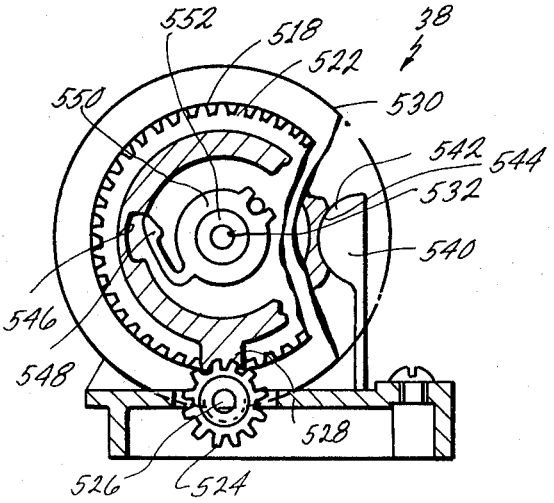
FIG. 17
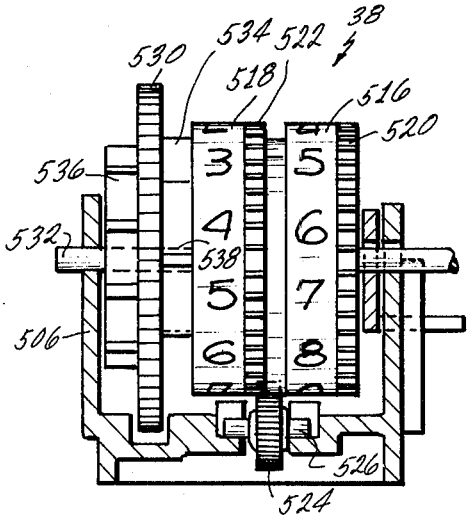

TOY HAVING PROJECTILE MOVABLE IN BOTH COORDINATES OF A PLANE

CROSS REFERENCE TO RELATED APPLICATIONS

This application is a continuation-in-part of my application entitled PORTABLE OBSTACLE TOY, Ser. No. 971,646, filed Dec. 21, 1978, the disclosure of which is herein incorporated by reference.

BACKGROUND OF THE INVENTION

This invention is directed to a portable electrical mechanical toy wherein a series of objects are automatically moved across the face of the toy and the operator of the toy fires a projectile at the objects by pushing a projectile launch button. The projectile automatically goes along a path perpendicular to the path of the object, however, the movement of the projectile can be further controlled in a path parallel to the path of the objects by a guidance wheel that is hand operated by the operator.

In my above noted application entitled PORTABLE OBSTACLE TOY I described existing apparatuses which utilize endless belts or film strips as the basis for creating a movement within an amusement device. In the apparatus described in my above noted application I utilize a plurality of endless belts capable of both forward and backward rotation about their respective mountings. The endless belts have a series of obstacles on their surfaces and an object which moves across the surface of the endless belts perpendicular to the direction of travel of the belts. As such all movement between the object and the endless belts is perpendicular movement.

In addition to this movement it is considered desirable to also include parallel movement between an object and a set of obstacles as well as the before described perpendicular movement. It is considered that the inclusion of parallel movement adds an additional degree of freedom which the operator must overcome or be cognizant of and therefore makes the toy more challenging and interesting to use.

BRIEF SUMMARY OF THE INVENTION

It is an object of this invention to provide a toy which has a series of objects which are repeatedly exposed to the pathway of a projectile such that the projectile is capable of "hitting" the object. These hits are translated into scoring points. As such it is a further object of the invention to provide a toy which challenges the operator of the toy by giving him a definite interval of time in which to accumulate as many scoring points as possible. An additional object of this invention includes allowing the operator to directly control the projectile in at least one direction or degree of freedom. It is a further object to provide an interesting and entertaining toy yet so construct the toy so as to render it relatively simple to manufacture and thus economical and accessible to a large segment of consumers.

These and other objects, as will be evident from the remainder of this specification and from the drawings, are achieved by providing a toy having a support structure or housing and located within the housing is at least one object which is movably positioned within the housing and is capable of movement along the x coordinate of an x, y, z coordinate system; also included is a projectile which is movably supported in the housing and is capable of attacking the object; the projectile can move in both the x and the y coordinates of an x, y, z coordinate system and when an object and the projectile have approximately the same x and y coordinate points but a different z coordinate point, since one is above the other, a "hit" between the projectile and the object occurs and is detected by a detecting system within the toy which can include both visual and audio signaling and also causes the accumulation of points on a scoring device.

The toy can further include the projectile having an internal signaling system such as a light which is in an on position when the projectile is attacking the object but is not in an on position when the projectile is returning to its starting or launch position. Detection of a "hit" between the projectile and the object is accomplished by electrical mechanical switches which are capable of detecting when the object and the projectile both have the same x and y coordinates or approximately the same x and y coordinates, within the limits of accuracy built into the game, while allowing continuous movement of the object along the x coordinate and movement of the projectile along both the x and y coordinates of an x, y, z coordinate system.

The toy can include a plurality of objects which are mounted on at least one endless belts which repeatedly cycle the object past any point on the endless belt. Normally two endless belts will be used which allow for one set of objects to be traveling in one direction and a second set of objects to be traveling in the other direction. This further allows, since the projectile is coming toward the objects along the path perpendicular to the endless belt, for graduations in scoring between a "hit" on one set of objects on one endless belt and a "hit" with another set of objects on the other endless belt. Because the projectile must traverse across the surface of one endless belt before it can strike objects on the other endless belt it is more likely to strike an object on the first endless belt. By putting more objects on the first endless belt and by assigning to them a rather low score for a hit it makes it more difficult to hit the objects on the second endless belt. The objects on the second endless belt are given a higher score because the operator must successfully evade hitting objects from the first endless belt before he can hit objects on the second endless belt.

The toy can include a timing mechanism which allows for a predetermined amount of time in which the operator can attempt to accumulate as many "hits" as possible and therefore as many scoring points as possible.

BRIEF DESCRIPTION OF THE FIGURES

This invention will be better understood when taken in conjunction with the drawings wherein:

FIG. 1 is an isometric projection of the toy of the invention in its entirety as it would be used by an operator;

FIG. 4 is a side elevational view in partial section of certain of the components of the toy which are located in the lower left corner of FIG. 2;

FIG. 5 is a top plan view of certain of the components of the toy found in the lower left portion of FIG. 2 and includes alternate positions of certain members shown by phantom lines;

FIG. 6 is a side elevational view in partial section taken about the line 6—6 of FIG. 5;

FIG. 10 is an end elevational view about the line 10—10 in FIG. 2;

FIG. 11 is an end elevational view about the line 11—11 in FIG. 2;

FIG. 16 is a side elevational view in section and partially broken away taken about the line 16—16 of FIG. 2;

FIG. 17 is an end elevational view about the line 17—17 of FIG. 2; and

FIG. 18 is a schematic view showing the electrical hookups between the electrical components of the invention.

Figure 2:
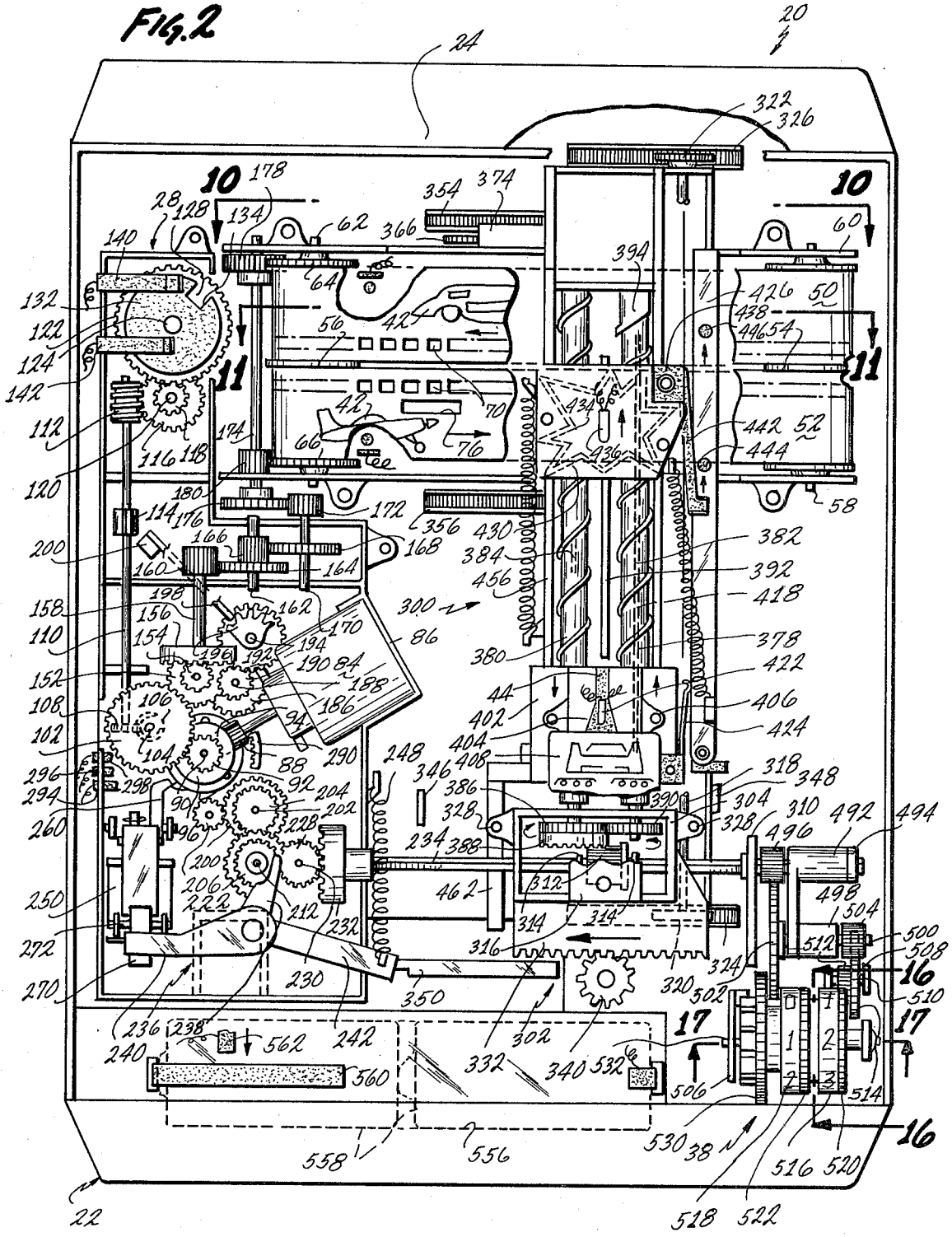
FIG. 2 is a top plan view of the invention shown in FIG. 1 with the cover removed and certain components cut away to show underlying components.

The invention described in this specification and illustrated in the drawings utilizes certain principles and concepts as are set forth in the appended claims. Those skilled in the art to which this invention pertains will readily recognize and appreciate that these concepts or principles could easily be applied to a number of differently appearing or differently describable embodiments. For this reason the invention is not to be construed as to be limited to the exact appearing embodiment shown and described, but is to be construed in light of the appended claims.

DETAILED DESCRIPTION

The toy 20 as shown in FIG. 1 has a housing 22 having a top 24 which when removed from the housing 22 exposes the working components within the housing. Centralized in the top 24 is a see through viewing window 26 through which certain of the interior components can be seen. To the left of the viewing window 26 is a timer 28 having a knurled knob 30 which is exposed through top 24 allowing it to be manipulated by the operator. Also projecting through top 24 is the off and on switch 32, the projectile launch button 34 and the guidance wheel 36. The remaining component exposed through the top 24 is the scoring indicator 38.

View window 26 has a clear plastic lens 40 through which can be seen one or more of several objects collectively identified by the numeral 42. As indicated by the arrows in FIG. 1 the objects 42 traverse across the view window 26 in a direction that is perpendicular to the longitudinal axis 43 of the toy. Near the bottom edge of view window 26 is a projectile 44 which contains an internal light source as hereinafter described which illuminates the projectile 44 whenever the light source is activated. The projectile 44 is capable of moving in a path along the longitudinal axis of the toy 20 toward the objects 42 as hereinafter described and is further capable of moving in a path parallel to the path of the objects 42 in response to turning of guidance wheel 36 by the operator of the toy.

In operation the off and on switch 32 is pushed to the on position and the knurled knob 30 is turned a few degrees until the pointer 46 corresponds to the numeral S molded in the top 24. This activates the timer 28 and starts the objects 42 to continually pass through the viewing window 26 in the directions as indicated in FIG. 1. The operator initiates movement of the projectile 44 toward the objects 42 by depressing projectile launch button 34. For use in this specification the movement of the object across the viewing window will be considered as movement along the x coordinate of an x, y, z coordinate system. The movement of the projectile 44 towards the object 42 will be considered the movement along the y coordinate of an x, y, z coordinate system. The vertical dimension of the toy is threfore along the z coordinate.

When the projectile launch button 34 is depressed the projectile 44 is automatically moved along the y coordinate toward the objects 42. The rate of speed of both the objects 42 across the view window 26 and the projectile 44 toward the object 42 is governed by the internal mechanism of the toy as hereinafter described. The movement of the projectile 44 along the x coordinate, that is in a path parallel to the movement of the objects 42, is governed by the operator by turning the guidance wheel 36. When the projectile 44 moves toward the objects 42 the interior light of the projectile 44 as hereinafter described is switched on lighting the projectile and making it visible through the view window 26. The projectile 44 proceeds toward the objects 42 and if it does not first "hit" any of the objects 42 as hereinafter described, then when it reaches a point near the top 48 of the view window 26 the light inside the projectile is turned off and the projectile returns to its starting position unseen by the operator.

As the projectile 44 approaches the objects 42 the operator can track the projectile 44 toward a particular object 42 by the use of the guidance wheel 36. If the projectile 44 scores a hit on the object 42, that is they both assume the same coordinate points along the x and y coordinates, a "hit" is scored. Depending upon which object is hit a series of points is accumulated in the score indicator 38. Additionally when a hit is scored a second light underneath the object part of the view window 26 flashes, a noise is emitted from the toy and the motion of the objects is stopped for an integral of time. This along with the accumulation of the scoring points signals to the operator that a hit has been scored. After the hit is scored the projectile 44 returns to its starting position, the objects 42 start moving again and the projectile 44 can once again be launched toward the objects 42 by depressing the projectiie launch button 34. This procedure is repeated until the timer pointer 46 makes almost a full 360° sweep of the timer dial and comes to rest next to numeral F, also molded on the top 24. The housing 24 and the view window 26 contain other nonfunctional features not numbered which contribute to the overall visual appearance and impression of the toy.

By removing the top 24 from the housing 22 the interior components are exposed as shown in FIG. 2. Within the housing 22 are numerous partitions and other structural elements which are not necessary for understanding of the invention but serve only as supports for other components which will be described. Included in this category also are drillings and bearings surfaces for gears and axles and also bosses which receive screws. For simplicity in this specification and readability of the drawings these numerous supports, screws, etc. are not numbered or described in any great detail.

Further as an aid in describing the toy the interior of the toy can generally be broken down into four main groups. These consists of the (a) objects, supports and associated drive mechanisms generally found near the top of the housing 22 in FIG. 2, (b) the motor, timer and associated gears generally found on the left side of FIG. 2, (c) the scoring indicator and associated gears generally found on the bottom right side of FIG. 2, and (d) the projectile and its associated components generally found to the right of center and extending from the bottom to the top of FIG. 2.

The objects 42 are printed upon the surface of two endless belts, top endless belt 50 and bottom endless belt 52. In operation the two endless belts move in different directions, however, alternate embodiments could have both endless belts moving in the same direction and could also include a greator or lesser number of endless belts. The endless belts are constructed of a see through plastic material or film. By the use of see through plastic material certain underlying components as hereinafter described can be viewed through the endless belts and additionally since the objects are generally depicted as flying objects, this allows for the visual effect of the objects being suspended within the housing 22 of the toy 20.

The endless belts 50 and 52 are suspended on a right endless belt spindle 54 and a left endless belt spindle 56. Spindle 54 is composed of two sections not separately numbered which are mounted on axle 58. Axle 58 is in turn supported in spindle support 60. The two sections of spindle 54 are independent and allow the endless belts 50 and 52 to each freely spin about axle 58 in different directions. Left spindle 56 is likewise composed of two sections, not separately numbered, the sections of which are suspended on axle 62 which in turn is supported in spindle support 60. However, contrary to right spindle 54 the two sections of left spindle 56 each have a spur gear 64 and 66 respectively attached on their outer edge. The spur gears 64 and 66 mate with other appropriate gears as hereinafter described which independently drive the two sections of spindle 56 in opposite directions.

Figure 3:
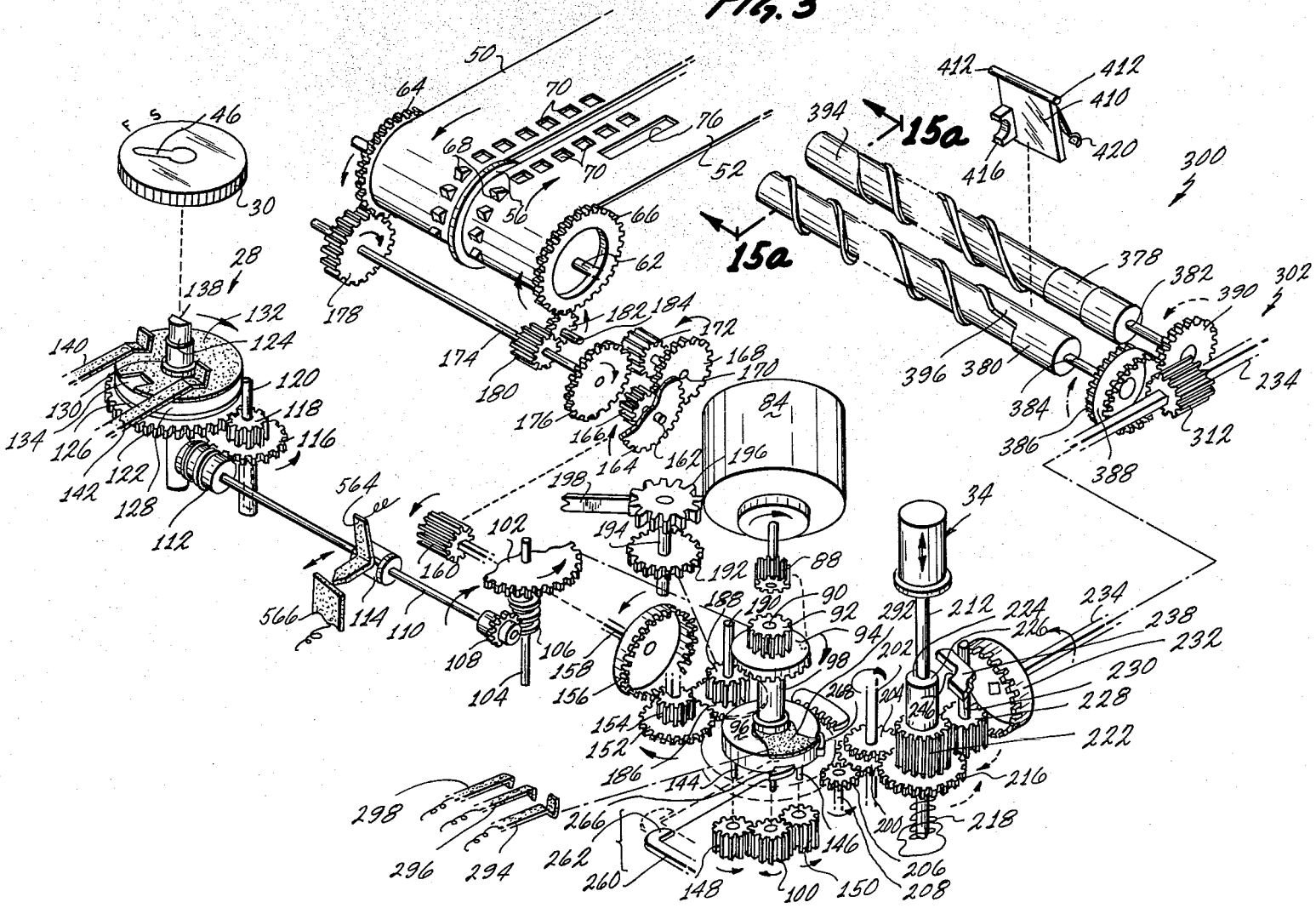
FIG. 3 is an exploded isometric view of certain of the mechanical components shown in FIG. 2.
Figure 7:
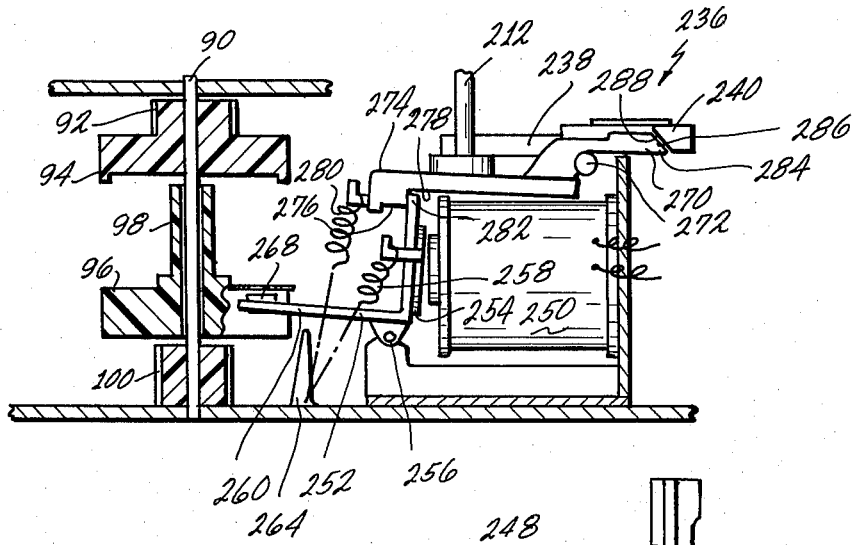
FIG. 7 is a side elevational view in partial section of the same components shown in FIG. 4 except that certain of the components are in a different spacial position to one another compared to FIG. 4.

As shown in FIG. 3 the two sections of left spindle 56 additionally have a series of teeth collectively identified by the numeral 68 which fit into appropriate holes collectively identified by the numeral 70 in both of the endless belts 50 and 52 and thereby transfer the motion of spur gears 64 and 66 to the respective belts 50 and 52. The endless belts 50 and 52 go over the top of the spindles 54 and 56 forming a flat segment on the uppermost portion of the endless belts 50 and 52, as is best illustrated in FIGS. 9 and 11, the endless belts 50 and 52 go underneath two stationary electrical contacts 72 and 74, the function of which will be hereinafter described.

Figure 9:
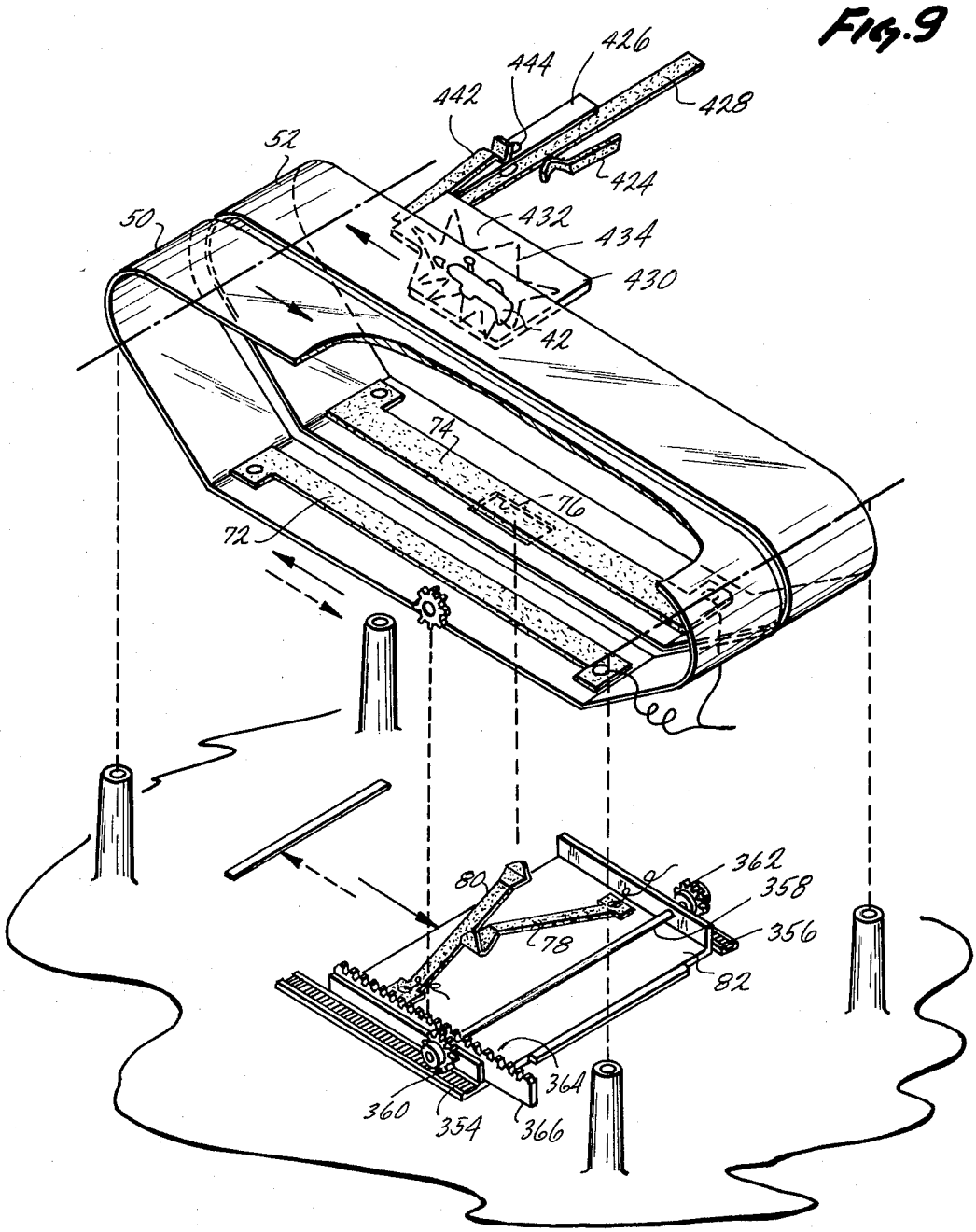
FIG. 9 is an exploded isometric view of certain components found in the upper portion of FIG. 2.

As seen in FIGS. 2, 3 and 9 the two endless belts 50 and 52 also contain several cutout sections collectively identified by the numeral 76. The cutout sections 76 are made in the surface of the endless belts 50 and 52 in certain positions which depend upon the positions of the objects 42 upon the endless belts 50 and 52. Fitting beneath the endless belts, as best seen in FIG. 9 are two spring electrical contacts 78 and 80. Spring electrical contacts 78 and 80 are mounted on a sliding housing 82 which will be described in greater detail later, however, the contacts 78 and 80 are so placed on sliding housing 82 that the tip of contact 78 can fit though each of the cutout sections 72 in endless belt 50 and make electrical contact with stationary contact 72. Likewise contact 80 can fit through each of the cutout sections 76 in endless belts 52 and make an electrical contact with stationary contact 74.

Each particular cutout section 76 corresponds to an object 42 which is 180° out of phase on either endless belt 50 or 52, that is when a particular object 42 is on the top surface of one of the endless belts and is exposed through viewing window 26 the cutout section 76 corresponding to that particular object 42 is on the bottom section of the endless belt positioned between the stationary contact 72 or 74 and the sliding housing 82 which carries the spring electrical contacts 78 and 80. Further details of this relationship will be discussed in relationship with the projectile and its associated components hereinafter.

A small electrical motor 84 is appropriately mounted in motor gear housing 86 and includes a small pinion 88 mounted on the motor shaft. An axle 90 has a pinion 92 and crown gear 94 which are integrally formed fixedly attached to its near its top surface. Underneath the crown gear 94 is a drum 96 having an upstanding cylindrical section 98 integrally formed on its upper surface. The drum and cylindrical section 96 and 98 fit on the center portion of axle 90 and are freewheeling and thus independent of any rotation of axle 90. Fixedly attached to the bottom of axle 90 is a pinion 100 which spins in response to movement of axle 90. Cylindrical section 98 serves as a spacer between the drum 96 and crown gear 94. Motor pinion 88 meshes with crown gear 94 spinning axle 90 and pinions 92 and 100 in response to motion of motor 84.

The timer 28 is mechanically driven by motor 84 by interaction of a spur gear 102 meshing with pinion 92. Spur gear 102 is fixedly attached to axle 104 which also has a worm gear fixedly attached to it. A worm wheel 108 meshes with worm gear 106 and transfers motion along shaft 110 to a second worm gear 112. Also attached to shaft 110 is three lobed cam 114 the function of which will be described hereinafter. Worm gear 112 meshes with a worm wheel 116 which along with a pinion 118 is fixedly attached to axle 120. Pinion 118 meshes with a spur gear 122.

A timer axle 124 has a collar (not shown) proximal to its bottom end and spur gear 122 fits around axle 124 and rests on the top of this collar. Lying on top of spur gear 122 is a rubber spacer ring 126. Fitting over rubber spacer ring 126 is a plastic disc 128 which has an upstanding boss 130 on its upper surface. A metal disc 132 having a notch 134 fits around boss 130 and rests on the surface of plastic disc 128. Metal disc 132 is fixedly attached to plastic disc 128 by ring 136. Axle 124 has a notch 138 on its upper surface and knurled knob 30 has a corresponding key (not numbered or shown) on its underside such that when knurled knob 30 slips over axle 124 the combination of the key and notch fixedly holds knurled knob 30 in position on axle 124. Pinion 118 drives spur gear 122, however, since spur gear 122 is freewheeling about axle 124 no motion of spur gear 122 is directly transferred to axle 124. Instead, rubber spacer ring 126 is squeezed between spur gear 122 and plastic disc 128 and as a consequence of the friction imparted by rubber spacer ring 126 the motion of spur gear 122 is transferred to plastic disc 128 and consequently to both metal disc 132 and timer axle 124.

Two contacts 140 and 142 project over the surface of metal disc 132 and touch metal disc 132 completing an electrical contact through the metal disc 132. Contact 140 is positioned near the edge of metal disc 132 and contact 142 is positioned closer to the center of metal disc 132. As the metal disc 132 rotates the notch 134 has one position wherein electrical contact between contact 140 and metal disc 132 is broken because the contact 140 slips into the notch 134 and touches the plastic spacer 128 breaking the electrical circuit. When this happens pointer 46 on the timer 28 is located between the letters F and S on the top 24 of housing 22 indicating that the timer 28 is not on. As hereinafter described the electrical circuit which drives motor 86 includes contact 140 and 142 and metal disc 132. When this contact is broken because of the location of contact 140 in notch 144 the motor no longer spins. The electrical contact can be reestablished by turning knurled knob 30 which in turn rotates timer axle 124 and metal disc 132 and reestablishes the electrical contact between contact 140 and metal disc 132. The motion of knurled knob 30, however, is not transferred to spur gear 122 because the rubber ring 126 allows the plastic disc 128 to rotate without rotating spur gear 122. There is just enough friction created by rubber ring 126 to allow spur gear 122 to drive plastic disc 128 but not enough to allow knurled knob 30 to turn spur gear 122 because of the mechanical advantage achieved through the gears which drive the timer.

Figure 8:
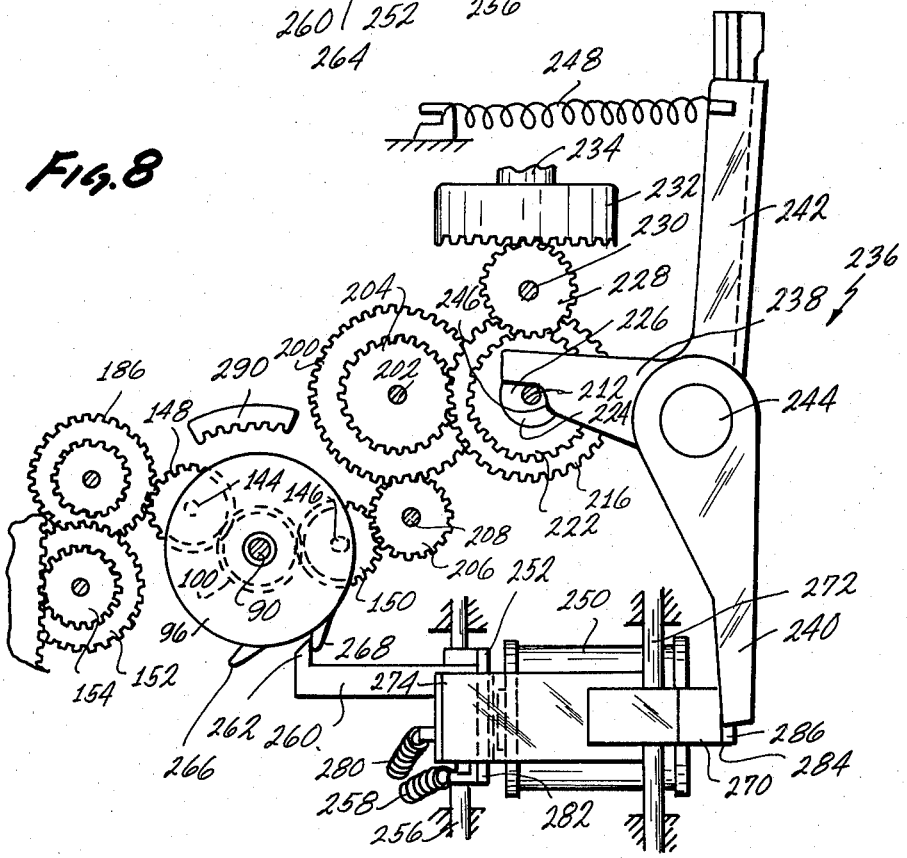
FIG. 8 is a top plan view of the same components shown in FIG. 5 except that certain components are in a different spacial relationship to one another as compared to FIG. 5.

Integrally formed with and projecting from the bottom of drum 90 are two short axles 144 and 146 as seen in FIG. 3. Two identical pinions 148 and 150 fit over axles 144 and 146 respectively and further because of the placement of axles 144 and 146 on drum 96 both pinion 148 and 150 mesh with and are rotated by pinion 100. Since pinion 100 is fixedly attached to axle 90 the motion of motor 84 is transferred to pinions 148 and 150 via pinion 100. Drum 96 and consequently pinions 148 and 150 are fixedly held as hereinafter described in two different positions as illustrated in FIGS. 5 and 8. In the first position hereinafter referred to as the firing position, the pinions and the drum are held as shown in FIG. 5. In the second position hereinafter referred to as the hit position, the pinions and the drum are held as shown in FIG. 8.

The motion of motor 86 is transferred to endless belts 50 and 52 by interaction of pinion 148 with spur gear 152 which in turn transfers motion to pinion 154 integrally formed with spur gear 152. Spur gear 152 and pinion 154 rotate on an axle (not numbered) and pinion 154 meshes with crown gear 156. Crown gear 156 is fixedly attached to axle 158 which has a pinion 160 fixedly attached to the other end. An axle 162 has a spur gear 164 and a pinion 166 fixedly attached thereto. Spur gear 164 interacts with pinion 160 and additionally spur gear 168 on an axle 170 interacts with pinion 166. Motion of spur gear 168 is transferred along axle 170 to pinion 172.

Referring now to FIG. 3 an axle 174 has a spur gear 176 on one end and a second spur gear 178 on the other end. Spur gear 176 interacts with pinion 172 and transfers the motion to axle 174. Spur gear 178 interacts with spindle drive spur gear 64 and transfers the motion of axle 174 to upper belt 50. Intermediate spur gears 176 and 178 fixedly attached on axle 174 is a pinion 180. Pinion 180 meshes with a second pinion 182 mounted on an axle 184. Pinion 182 also meshes with spindle spur gear 66. Since rotation of axle 174 goes through an extra gear, i.e. pinion 182, rotation of spindle spur gear 66 is in the opposite direction of rotation of spindle spur gear 64, thus endless belt 52 travels in an opposite direction to belt 50.

In the second position, the hit position, the relationship of drum 96 and pinions 148 and 150 is shown in FIG. 8. In this position pinion 148 interacts with spur gear 186. Fixedly attached to spur gear 186 on axle 188 is pinion 190. A spur gear 192 mounted on axle 194 interacts with pinion 190 and transfers motion via axle 194 to clicker gear 196. A clicker arm 198 is attached to angle member 200 which is appropriately mounted on the top of motor gear housing 86. When in the hit position rotation of motor 84 is transferred to clicker gear 196. As clicker gear 196 rotates clicker arm 198 strikes the teeth of clicker gear 196 and emits a sound, the significance of which will be hereinafter outlined.

Referring back to FIG. 5 when in the firing position pinion 150 interacts with spur gear 200. Spur gear 200 is fixedly attached to axle 202 and also fixedly attached to axle 202 is a second spur gear 204. However, in the hit position shown in FIG. 8 pinion 150 interacts with small spur gear 206 which is appropriately mounted on axle 208 and which also meshes with spur gear 200. The gear train shown in FIG. 5 allows motion of motor 84 to be transferred from pinion 100 to pinion 150, then to spur gear 200 and finally spur gear 204. This results in spur gear 204 rotating in one direction. If however, this gear train is disrupted between pinion 150 and spur gear 200 and goes through the extra gear, spur gear 206 as shown in FIG. 8, the resulting rotation of spur gear 204 is in the opposite direction. In the exploded view shown in FIG. 3 pinions 148 and 150 are in the firing position. This also corresponds to the position shown in FIG. 5. Motor 84 is chosen such that its rotation as shown in FIG. 3 is clockwise. By the appropriate gearing as described in FIGS. 3 and 5 spur gear 204 also rotates clockwise, the significance of which will be hereinafter described.

As shown in FIGS. 3 and 6 the projectile launch button 34 fits over an upstanding collar 210 integrally formed on the top of motor gear housing 86. A shaft 212 fits within the interior of collar 210 and a central projection 214 integrally formed with projectile launch button 34 fits through the top of collar 210 and abuts against the top of shaft 212. A spur gear 216 is fixedly attached to shaft 212. A spring 218 fits underneath spur gear 216 around shaft 212 and biases spur gear 216 and shaft 212 in an upward direction. Motor gear housing 86 has a hole 220 through its bottom. This hole 220 is slightly larger than shaft 212 thus allowing shaft 212 to freely slide up and down in hole 220 and collar 210.

A long pinion 222 is integrally formed with top of spur gear 216 and thus is also fixedly attached to shaft 212. Integrally formed on the top of long pinion 222 is a cylindrical member 224. Cylindrical member 224 fits around shaft 212 and thus its top surface forms a shoulder 226. As shaft 212 slides up and down because of movement imparted to it by either projectile launch button 34 or spring 218 shoulder 226 also moves up and down. A pinion 228 meshes with and is in continuous contact with long pinion 222 throughout the length of travel of pinion 222 in response to travel of shaft 212. Pinion 228 is mounted on axle 230 and transfers its motion to a crown gear 232 with which it is in contact with.

Because of the pressure exerted by spring 218 spur gear 216 is not always in contact with spur gear 204 but is slightly elevated above spur gear 204. When projectile launch button 234 is depressed shaft 212 descends and spur gear 206 intermeshes with spur gear 204. When spur gear 216 is in contact with spur gear 204 the rotary motion of spur gear 204, be it clockwise or counterclockwise is transferred to crown gear 232. Further motion from crown gear 232 is carried by shaft 234 to the scoring indicator and the projectile and its associated components as hereinafter described.

A three armed member 236 having a lock arm 238, a solonoid trip arm 240 and a release arm 242 is rotatably mounted about an upright shaft 244 within the motor gear housing 86. The end of lock arm 238 projecting away from upright shaft 244 contains a small arcular indent 246 which abuts against the side of cylindrical member 224. A spring 248 attaches to the end of release arm 242 and to the side of motor gear housing 86. Spring 248 biases the three armed member 236 about shaft 234 such that indent 246 is held against the side of cylindrical member 224. When the projectile launch button 34 is depressed cylindrical member 224 descends in response to downward movement of shaft 212. When spur gear 216 meshes with spur gear 204 the shoulder 226 on cylindrical member 224 descends below the plane of the indent 246 on lock arm 238. Under the influence of spring 248 the three armed member 236 pivots about shaft 234 until the indent 246 comes to rest against shaft 212.

As noted previously shaft 212 and all of the components attached thereto are urged in an upward direction by spring 218, however, once the shoulder 226 of cylindrical member 224 clears the indent 246 shaft 212 cannot be pushed upward by the force exerted by spring 218 because the shoulder 226 fits under and is now locked underneath lock arm 238. This holds spur gear 216 in contact with spur gear 204 until such time as the lock arm 238 moves away from the shaft 212 and allows cylindrical member 224 and consequently shaft 212 and all components attached thereto to be pushed upward by spring 218. FIG. 5 shows the three armed member 236 in both solid lines and phantom lines. The solid lines represent its position when the indent 246 rests against the side of cylindrical member 224 and the phantom lines represent the position wherein the indent 246 rests against shaft 212 locking spur gear 216 with spur gear 204. The position of the three armed member 236 in FIG. 8 corresponds to the phantom position shown in FIG. 5.

Located within the motor gear housing 86 is a solenoid 250. As seen in FIGS. 4, 5, 7 and 8 the solenoid 250 is located near drum 96 and below solonoid trip arm 240. Positioned in front of solenoid 250 is an angled member 252 having a soft iron metal plate 254 attached to its surface. Angled member 252 is pivoted about pivot pin 256 such that the metal plate 254 can be drawn towards solenoid 250 and pulled back away from solonoid 250 by spring 258. An arm 260 projects from angled member 252 toward drum 96. The arm 260 has a small detent finger 262 on its end. A stop member 264 projects from the bottom surface of motor gear housing 86 and limits the amount of travel of angled member 252 away from solenoid 250 under the influence of spring 258.

Located on the surface of drum 96 are two ratchet teeth, bottom ratchet tooth 266 and top ratchet tooth 268. Bottom ratchet tooth 266 is spaced below the horizontal plane of top ratchet tooth 268 as best seen in FIG. 4 and bottom ratchet tooth 266 is spaced approximately 45° clockwise from top ratchet tooth 268 as best seen in FIG. 5.

Because of the direction of rotation chosen for motor 84 and the interaction of pinion 100 with pinions 148 and 150 which are mounted on drum 96 on axles 144 and 146, drum 96 when viewed from the top is given a clockwise momentum. The detent finger 262 on arm 260 is so positioned that it fits within the locus of travel of both the ratchet teeth 266 and 268 as drum 96 spins about axle 90. The clockwise momentum of drum 96 tends to hold either bottom ratchet tooth 266 or top ratchet tooth 268 against detent finger 262 retaining drum 96 in one of two positions, the first position as previously described, the firing position, or the second position as previously described, the hit position respectively.

When arm 260 is resting on the top of stop member 264 the detent finger 262 will catch and hold bottom ratchet tooth 266. This maintains the drum 96 and pinions 148 and 154 in the first position. When the solenoid is activated, as hereinafter described, the metal plate 254 is drawn toward the solonoid pivoting the angled member 252 about pivot pin 256 and raising arm 260 such that detent finger 262 is now in position wherein it will catch and hold top ratchet tooth 268. The uppermost limit of travel of arm 260 is governed by metal plate 254 abuting against the solonoid 250. This maintains drum 96 and pinions 148 and 150 in the hit position.

Positioned above solenoid 250 is a pivoted lock member 270. This member 270 pivots about pivot pins 272 appropriately located in motor gear housing 86. The underside of end 274 of pivot lock member 270 contains two shoulders, firing shoulder 276 and hit shoulder 278 respectively. A spring 280 attached to end 274 of pivot lock member 270 biases end 270 downward such that the top edge 282 of angled member 252 fits underneath pivot lock member 270 against either firing shoulder 276 or hit shoulder 278. When solenoid 250 is activated as hereinafter described angled member 252 is drawn toward solonoid 250. When this happens top edge 282 slides along the underside of pivot lock member 270 from firing shoulder 276 to hit shoulder 278. Spring 280 pulls pivot lock member 270 downward and traps top edge 282 in hit shoulder 278. When this happens, even if the electrical current in solenoid 250 is disrupted, angled member 252 cannot return to the firing position because it is locked by hit shoulder 278 holding top edge 282. When top edge 282 is in firing shoulder 276 detent finger 262 is in position to interact with bottom ratchet tooth 266. When top edge 282 is in hit shoulder 278 detent finger 262 is in position to interact with top ratchet tooth 268.

The second end 284 of pivot lock member 270 contains a beveled edge 286 which is positioned beneath solenoid trip arm 240. Solenoid trip arm 240 also contains a beveled edge 288. When indent 246 on lock arm 238 is located on the side of cylindrical member 224 solenoid trip arm 240 fits over end 284 of pivot lock member 270 pivoting pivot lock member 270 about pivot pin 272 such that the top edge 282 of angled member 252 is positioned in firing shoulder 276. This is the position shown in solid lines in FIG. 5 of solonoid trip arm 240. When the projectile launch button 34 is depressed allowing three armed member 236 to pivot about shaft 234, as previously described, the beveled end 286 of solenoid trip arm 240 moves away from end 284 of pivot lock member 270 and if the solenoid 250 is activated allowing end 274 of pivot lock member 270 to move downward the second end 284 moves upward and its beveled edge 286 comes to rest against beveled edge 288 of the trip arm 240. This is the position shown in phantom lines in FIG. 5 and also the position shown in FIG. 7.

When release arm 242 is pushed against the bias of spring 248, as hereinafter described, three armed member 236 rotates about shaft 234 causing the two beveled edges 286 and 288, just described, to push against one another forcing end 284 of pivot lock member 270 downward and raising the opposite end 274. This allows top edge 282 of angled member 252 to be freed from hit shoulder 278 and return under the influence of spring 258 to its position in the firing shoulder 276 and consequently causes detent finger 266 to release top ratchet tooth 268. The rotational momentum of drum 296 spins it in a clockwise direction until pinion 148 engages with angular gear rack 290. The interaction of pinion 148 with gear rack 290 continues to rotate drum 96 in a clockwise direction. After pinion 148 is freed from gear rack 290 it interacts with spur gear 200 and subsequently with spur gear 206. Since drum 96 is freewheeling about axle 90 this does not rotate either of these two gears but only maintains the clockwise rotation of drum 96. After pinion 148 is free of spur gear 206 pinion 150 meshes with spur gear 152 and subsequently spur gear 188 and gear rack 290. After pinion 150 clears gear rack 290 bottom ratchet tooth 266 is now in position to catch against detent finger 262 which it does holding the drum 96 in the firing position. As was the case with pinion 148, when pinion 150 is traveling it does not turn pinions 152 or 188 but simply "walks" along their teeth. As soon as bottom ratchet 256 interacts with detent finger 262 drum 96 is no longer free to spin and the rotation of pinion 100 is now once again transferred by pinion 148 and 150 to spur gears 152 and 200.

Attached to the surface of drum 96 and extending about an arc of about 45° is a metal electrical contact surface 292. Three electrical contacts 294, 296 and 298 respectively extend through the side of motor gear housing 86 over the surface of drum 96 and metal contact 292. The contacts 294, 296 and 298 are shown in FIGS. 2 and 3. When drum 96 is in the firing position as shown in FIG. 5 electrical contacts 294 and 296 touch metal contact surface 292 and complete a circuit through this contact surface. When drum 96 is in the hit position as shown in FIG. 8 electrical contacts 296 and 298 touch metal contact surface 292 and complete an electrical circuit. The significance of these two electrical circuits will be discussed hereinafter.

A projectile housing 300 is slidably mounted within housing 22 such that it is capable of moving back and forth in the x coordinate of the before discussed x, y, z coordinate system. In FIG. 2 this x coordinate movement results in the housing 300 moving from left to right between a position to the right of center to a position slightly to the left of center and vice versa. Near end 302 of housing 300 is a gear compartment 304 having cutouts, collectively identified by the numeral 306, on either side. Square shaft 234 which is attached at one end to crown gear 232 and at the other end after passing through a mounting 310 to the scoring indicator as hereinafter described passes through the cutouts 306 into and out of gear compartment 304. A long pinion 312 having a square centralized hole is slidably mounted on square shaft 234 within gear compartment 304. The long pinion 312 is fixedly held within the interior of gear compartment 304 by two fixed spacers collectively identified by the numeral 314 which project down from the gear compartment cover 316. The two spacers 314 maintain the long pinion 312 in a centralized position within the gear compartment 304. As projectile housing 300 slides back and forth within housing 22 this allows long pinion 312 to slide along square shaft 234 yet at the same time to be maintained in a fixed position with respect to other components within the gear compartment 304. By virtue of the square shaft and the square hole in long pinion 312 rotation of shaft 234 can be transferred to long pinion 312 while allowing pinion 312 to assume a variety of placements along the length of shaft 234.

Extending along the longitudinal axis 308 (i.e. the y coordinate) of the projectile housing 300 is a long shaft 318 having identical gears 320 and 322 on either end thereof. The gears 320 and 322 fit into two gear racks 324 and 326 attached on the bottom of the housing 22. The shaft 318, the gears 320 and 322 and the gear racks 324 and 326 maintain the projectile housing 300 in a fixed orientation along the y coordinate (i.e. the vertical coordinate of FIG. 2). Thus if the end 302 of projectile housing 300 is moved this causes gear 320 to move along gear rack 324. Since gear 320 is fixedly attached to long shaft 318 its rotation is transferred to gear 322 which is also fixedly attached to long shaft 318. The rotation of gear 320 in gear rack 324 causes an identical rotation of gear 322 in gear rack 326 which maintains perfect alignment in the y coordinate of the projectile housing 300 on the bottom surface of housing 22.

Movement of the projectile housing 300 along the x coordinate is accomplished by turning the guidance wheel 36. The gear compartment cover 316 is screwed onto the projectile housing 300 by screws going through the two holes collectively identified by the numeral 328 in the gear rack cover 316 and two bosses collectively identified by the numeral 330 in the projectile housing 300. Along one side of gear rack cover 316 is a gear rack 332. A guidance wheel shaft 334 fits in an upstanding bearing 336 projecting out of the housing 22. The upper end of the guidance shaft 334 passes through an appropriate hole in top 28 and guidance wheel 36 is then attached to it.

Fixedly attached to guidance shaft 334 near its upper end is a flange 338 whose underside has a series of cam surfaces. Freely attached around guidance shaft 334 is a pinion 340 whose upper surface has a mirror image cam surface to that of flange 338. This allows the cam surfaces of flange 338 and pinion 340 to mesh. Attached near the bottom of guidance shaft 334 is a second flange 342. Interspaced between flange 342 and the bottom of pinion 340 around guidance shaft 334 is a spring 344. Spring 344 biases pinion 340 against flange 338. Pinion 340 meshes with gear rack 332 attached to gear compartment cover 316. Rotation of guidance wheel 36 is thus transferred to flange 338 and to pinion 340. This rotational movement is converted to reciprocal movement of projectile housing 300 by the interaction of pinion 340 with gear rack 332.

Two stops, a left stop and a right stop, 346 and 348 respectively project from the bottom surface of housing 22 and limit the travel of the projectile housing 300 in both the left and right direction of FIG. 2. When the guidance wheel 36 is turned such that the projectile housing 300 assumes either its extreme left or right side position the projectile housing 300 is stopped. If the operator continues to turn the guidance wheel 36 the cam surfaces between flange 38 and pinion 40 will slip in respect to one another pushing pinion 340 against spring 342. This serves as a clutch mechanism to compensate in case the operator continues turning the guidance wheel 34 when the projectile housing 300 is at either of its limits of travel.

Figure 12:
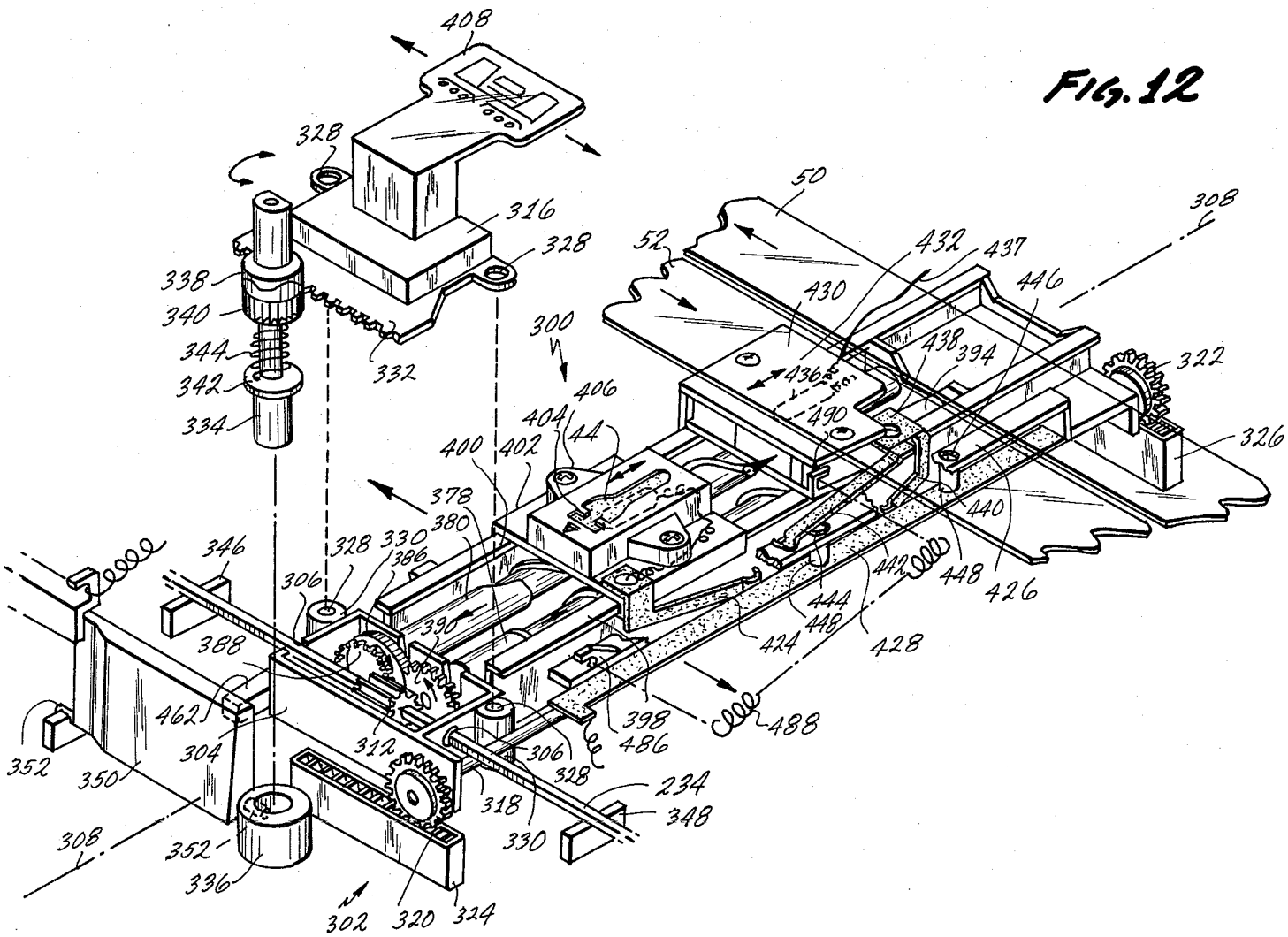
FIG. 12 is an isometric view partially exploded of certain components generally found to the right of the center of FIG. 2.

In FIG. 12 mounted to the right of bearing 336 is release arm trip plate 350. Near the bottom of trip plate 350 are two pins collectively numbered by the numeral 352 which fit into appropriate drillings (not numbered) one in bearing 336 and the other in motor gear housing 86. This allows release arm trip plate 350 to pivot. Release arm trip plate 350 fits against release arm 242 of the three armed member 236. When release arm trip plate 350 is struck as hereinafter described, this motion is communicated to the release arm 242 and consequently to the remainder of the three armed member 236 as hereinafore described.

Figures 13, 14, 15, 15A:
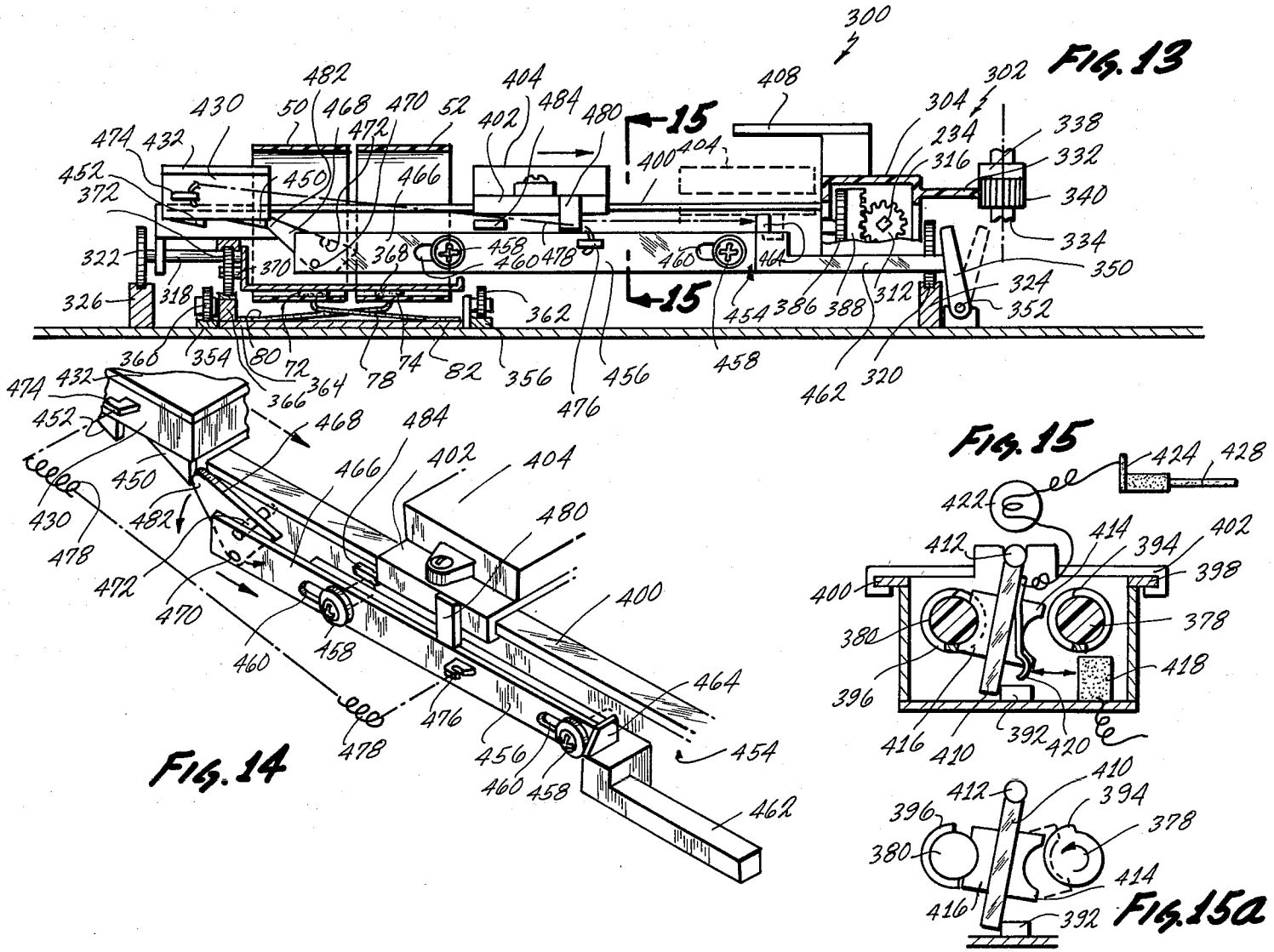
FIG. 13 is a side elevational view of the components shown in FIG. 12 as viewed from the left side of FIG. 12.
FIG. 14 is an isometric view of the components foremost of the components shown in FIG. 13.
FIG. 15 is an end elevational view about the line 15—15 of FIG. 13.
FIG. 15*a* is an end elevational view similar to FIG. 15 but taken at the position shown by the line 15*a*—15*a* of FIG. 3.

Two gear racks 354 and 356 respectively are mounted on the floor of housing 22 beneath the travel path of projectile housing 300. These two gear racks 354 and 356 are oriented along the x coordinate as seen in FIG. 2. Sliding housing 82 fits within the gear racks 354 and 356 as shown in FIGS. 9 and 13. A shaft 358 extends through sliding housing 82 and mounted on the respective ends of shaft 358 are two small gears 360 and 362. Gear 360 meshes with rack 354 and gear 362 meshes with rack 356. The side 364 of housing 82 closest to gear rack 354 has a rack of gears 366 integrally formed on its top surface.

Spindle support 60 includes a bottom plate 368 to which the two stationary electrical contacts 72 and 74 are mounted on the bottom side thereof. As seen in FIG. 11 this bottom plate 368 holds the contacts 72 and 74 and also determines the shape of the bottom side of endless belts 50 and 52. Projecting out of the side of spindle support 60 near this bottom plate 368 is a small axle 370. A small gear 372 fits over this axle and is freewheeling upon axle 370. Integrally formed on the bottom side of projectile housing 300 near the top end 374 (as viewed in FIG. 2) of the projectile housing 300 is a rack of gears 376 which are identical to the rack 366. Gear 372 meshes with both rack 366 and rack 376. Since spindle support 60 is firmly fixed to housing 22, axle 370 is also firmly fixed in relationship to the housing 22. As projectile housing 300 moves from right to left or left to right, rack 376 causes gear 372 to turn about axle 370. Since gear 372 cannot move in respect to housing 22, but is free to turn, its rotary motion is transferred to rack 366 and consequently to sliding housing 82 causing sliding housing 82 to travel in between gear racks 354 and 356 along the bottom surface of housing 22.

As a consequence of travel of the projectile housing 300 to the right sliding housing 82 is slid to the left and as projectile housing 300 slides to the left sliding housing 82 is slid by the same amount to the right. As noted previously the objects 42 are spaced 180° on the surface of either of the endless belts 50 and 52 from the cutout sections 76 corresponding to the particular objects 42. If the projectile housing 300 is positioned directly between the right and left belt spindle 54 and 56 the sliding housing 82 will also be centered in respect to these two spindles. If an object 42 were directly over the projectile housing 300 at this point the spring contacts 78 or 80 would be positioned below the appropriate cutouts 76 and could therefore contact one of the stationary contacts 72 or 74. If as shown in FIG. 11 the projectile housing 300 is slightly off center toward spindle 54 the sliding housing 82 would be slightly off center to the same degree toward spindle 56. Since the cutout 76 corresponding to the particular object 42 shown in FIG. 11 is positioned 180° on belt 50 away from object 42 the spring electrical contact 78 is in position to fit through the appropriate cutout 76 and make contact with contact 72. As hereinafter described the contacts 78 and 80 and the cutout sections 76 are part of the mechanisms which sense when a "hit" between an object 42 and the projectile 44 occurs. By the placement of spring contacts 78 and 80 on the sliding housing 82, which moves in the opposite direction to projectile housing 300 but the same distance as projectile housing 300, the contacts 78 and 80 will always be in the correct position along the x coordinate to sense the position of the projectile housing 300 and therefore the position of the projectile 44.

Mounted along the longitudinal axis 308 of projectile housing 300 are two long cylindrical screws, a right cylindrical screw 378 and a left cylindrical screw 380. Both right cylindrical screw 378 and left cylindrical screw 380 are formed by a ridge (not separately numbered) winding around a central cylinder (not separately numbered) in a helical manner. A central axle 382 passes through right cylindrical screw 378 and an identical central axle 384 passes through left cylindrical screw. Both the left and the right cylindrical screws 380 and 378 respectively are rotary mounted within the projectile housing 300 by appropriate bearing surfaces which receive the axles 382 and 384 respectively. Attached to one end of axle 384 is a spur gear 386 having a set of crown teeth 388 also formed on the face of the gear. Attached to the end of axle 382 is a spur gear 390. When appropriately mounted in projectile housing 300 the gears 386 and 390 are located in gear compartment 304. Spur gear 390 meshes with spur gear 386 and the crown teeth 388 on gear 386 mesh with long pinion 312. By this arrangement rotation of shaft 234 is first transferred to gear 386 and then to gear 390, however, this results in gear 386 turning left cylindrical screw 380 in one direction while gear 390 turns right cylindrical screw 378 in the opposite direction.

Projecting from the bottom surface of projectile housing 300 in between right and left cylindrical screws 378 and 380 is an elongated partition member 392. Elongated partition member 392 does not travel the full length of the cylindrical screws 378 and 380. At both ends of the elongated partition member 392 there is a free space between the right and left cylindrical screws 378 and 380. On the end of right cylindrical screw 378 nearest end 374 of projectile housing 300 (toward the top of FIG. 2) is a cam surface 394. At the end of left cylindrical screw 380 nearest end 302 of projectile housing 300 is a cam surface 396.

Mounted on the upper edges of projectile housing 300 are a right and a left track member 398 and 400 respectively. These two track members 398 and 400 traverse the full length of projectile housing 300 from end 302 to end 374. A projectile slide member 402 fits on top of projectile housing 300 around track members 398 and 400. Projectile slide member 402 is free to slide along tracks 398 and 400 in the y coordinate or from top to bottom as seen in FIG. 2. Projectile slide member 402 has a clear plastic cover 404 having identical ears 406 through which two screws pass attaching the cover 404 to the slide member 402. Painted on the surface of the cover 404 is the projectile 44.

Extending from the gear compartment cover 316 is a clear plastic member 408 having a projectile launch apparatus painted thereon. When the projectile slide member 402 is in its "ready" position (which corresponds to the fire position for other parts previously described) part of the projectile 406 is located underneath the plastic member 408 as is shown in FIG. 2 and in phantom lines in FIG. 13.

A projectile drive member 410 is suspended from the projectile slide member 402 by two pins collectively identified by the numeral 412 which fit into appropriate bearing surfaces (not shown) in the projectile slide member 402. The projectile drive member 410 hangs within the projectile housing 300 in between right cylindrical screw 378 and left cylindrical screw 380. As seen in FIGS. 15 and 15*a* the projectile drive member 410 projects down past the upper surface of the elongated partition member 392 and is held against one side or the other of elongated partition member 392 along the length of the projectile housing 300 except for the free spaces at both ends of the partition member 392. Projecting from the right side of projectile drive member 410 is right drive member 414 and projecting from the left side of projectile drive member 410 is left drive member 416. Both the right and the left drive members 414 and 416 have an arculated indent in their surface, said indent which will fit snugly against the round surfaces of right or left cylindrical screws 378 and 380, but will not fit around the ridges which wind around the cylindrical bodies and form the helical screw surfaces. When projectile drive member is shown in the position as illustrated in FIG. 15 the left drive member 416 fits against the left cylindrical screw 380 and is held there by the elongated partition member 392. As left cylindrical screw 380 turns the ridge on the surface of left cylindrical screw 380 interacts with left drive member 416 and drives projectile drive member 410 along the longitudinal axis of left cylindrical screw 380 in a direction which is dependent upon the direction of rotation of left cylindrical screw 380. When the projectile drive member 410 is on the other side of elongated partition member 392 and right drive member 414 is flush against right cylindrical screw 378 the projectile drive member 410 is driven by right cylindrical screw 378 in a like manner.

When in the firing position which includes the projectile 44 being in its ready position and projectile launch button 34 is depressed shaft 234 is rotated by crown gear 232 as previously described. This rotation is transferred to the right and left cylindrical screws 378 and 380 such that when viewed from end 302 of projectile housing 300 left cylindrical screw 380 turns in a clockwise direction and right cylindrical screw 378 turns in a counterclockwise direction. If the projectile slide member 402 is positioned in its ready position clockwise rotation of left cylindrical screw 380 causes cam surface 396 to interact with left drive member 416 and pushes projectile drive member 410 across the free space between the right and left cylindrical screws 378 and 380 until right drive member 414 comes in contact with right cylindrical screw 378. The ridges on the right cylindrical screw 378 interact with right drive member 414 and because of the orientation of the ridges as shown in the figures, counterclockwise rotation of right cylindrical screw 378 causes slide member 402 to slide toward end 374 of the projectile housing 300. The projectile drive member 410 immediately becomes locked on the right side of elongated partition member 392 and the projectile slide member 402 advances.

When the projectile slide member 402 reaches the end of the right cylindrical screw 378 nearest end 374 of the projectile housing 300 (other intervening events are being ignored at this time for simplicity) the right drive member 414 comes in contact with cam surface 394 which pushes projectile drive member 410 across the free space at the end of the elongated partition member 392 between right cylindrical screw 378 and left cylindrical screw 380 until left drive member 416 contacts left cylindrical screw 380 as is shown in FIG. 15*a*. At this time left cylindrical screw 380 by virtue of its clockwise rotation starts to slide projectile slide member 402 back toward end 302 by the interaction of the ridges on left cylindrical screw 380 with the left drive member 416. The projectile slide member 402 travels back to its ready position so once again the cam surface 396 on left cylindrical screw 380 can flip the projectile drive member 410 back against the right cylindrical screw 378.

As shown in FIGS. 2 and 15 lying below right cylindrical screw 378 is an electrical contact strip 418. Attached to the right side of projectile drive member 410 is a spring electrical contact 420. Whenever projectile drive member 410 is on the right side of projectile housing 300 such that right drive member 414 is against right cylindrical screw 378, spring electrical contact 420 contacts electrical contact strip 418 making an electrical connection between the two. When projectile drive member 410 is flipped over to the left side of projectile slide member 402 this contact is broken. Positioned between cover 404 and projectile slide member 402 directly underneath the projectile pitcher 44 is a light bulb 422. This light bulb 422 is wired at one point to spring electrical contact 420 and at the other point to sliding electrical contact 424.

On the right side of projectile housing 300 and integrally formed with projectile housing 300 is a projectile housing side extension 426. Supported beneath side extension 426 is an elongated electrical contact strip 428. Sliding electrical contact 424 touches elongated electrical contact strip 428 and completes an electrical circuit with this contact strip 428 as projectile slide member 402 goes back and forth along the track members 398 and 400.

Also mounted on track members 398 and 400 is a sliding hit member 430. Sliding hit member 430 has a see-through cover 432 having an explosion-like design 434 incorporated on its surface. Positioned between the see-through cover 432 and the sliding hit member 430 is a hit indicator light bulb 436 which when lit illuminates explosion-like design 434. An electrical wire 437 is wired to one side of hit indicator light 436 and the other side is wired to electrical contact member 438. Electrical contact member 438 has two contacts projecting from it, sliding contact 440 and hit contact 442. Sliding contact 440 is always in continuous sliding contact with elongated electrical contact strip 428. Thus as sliding hit member 430 is slid along tracks 398 and 400 as hereinafter described sliding contact 440 remains in electrical contact with elongated strip contact 428.

Two round electrical contacts project slightly above the surface of side extension 426. The first of these contacts, the bottom endless belt contact 444 is positioned close to end 302 and the top endless belt contact 446 is positioned closest to end 374. As sliding hit member 430 travels along tracks 398 and 400 hit contact 442 first makes electrical contact with contact 444 and if allowed to slide further up tracks 398 and 400 toward end 374 it then will make electrical contact with contact 446. As will be further discussed hereinafter contact 444 is wired to and makes an electrical connection with spring electrical contact 80 and contact 446 is wired to and makes an electrical contact with spring electrical contact 78. Surrounding both contact 444 and 446 where they pass through elongated electrical contact strip 428 are two insulating sleeves identically identified by the numeral 448. This prevents any electrical short between elongated strip contact 428 and contacts 444 and 446.

On the left side of sliding hit member 430 are two small ratchet teeth 450 and 452 respectively which project from the bottom of sliding member 430 toward the bottom of housing 22. On the left side 454 of projectile housing 300 is sliding trip member 456. Sliding trip member 456 is mounted to projectile housing 300 by two screws collectively identified by the numeral 458 which pass through elongated slots 460 in sliding trip member 456. Projecting from one end of sliding trip member 456 is trip plate contact member 462. At the junction of sliding trip member 456 and trip plate contact member 462 is stop member 464 which projects in an upward direction. On the other end of sliding trip member 456 is sliding pawl extension 466 which is integrally formed with sliding trip member 456 but is spaced away from the left side 454 of projectile housing 300.

In between side 454 and pawl extension 466 is pawl 468. Pawl 468 is pivotally attached to pawl extension 466 by bottom pawl pin 470 which extends from pawl extension 466 and into a corresponding hole (not numbered) near the bottom of pawl 468. Additionally pawl 468 is pivotally attached to side 454 by top pawl pin 472 which passes through an appropriate hole in pawl 468 (not separately numbered). This allows pawl 468 to pivot on side 454 when sliding trip member 456 is moved. Extending out of the left side of sliding hit member 430 is a spring retention member 474. And extending out of the side of sliding trip member 456 is a second spring retention member 476. A spring 478 connects between these two spring retention members. This spring biases sliding hit member 430 toward sliding trip member 456 causing pawl 468 to rotate about top pawl pin 472 and project in the pathway of the two ratchet teeth 450 and 452 attached to the bottom of sliding trip member 430.

Projecting out of and downward on the left side of projectile slide member 402 is a trip peg 480. When the projectile slide travels down track members 398 and 400 towards end 302, as previously described, trip peg 480 abuts against stop peg 464 sliding sliding trip member 456 rearward which in turn causes pawl 468 to pivot about top pawl pin 472 such that the end 482 of pawl 468 descends. This allows sliding hit member 430 to slide along tracks 398 and 400 toward end 302 until ratchet tooth 450 abuts against sliding hit member rest peg 484 attached to the side 454 of housing 300. A spring retention member 486 on the surface of side extension 426 retains one end of a spring 488. The other end of spring 488 is attached to spring retention member 490 on the right side of sliding hit member 430. This biases sliding hit member 430 toward end 302. The spring 478 on the left side of sliding hit member 430 connecting to sliding trip member 456 biases sliding trip member 456 toward sliding hit member 430 such that end 480 of pawl 468 is biased in an upward direction.

As mentioned above sliding hit member 430 is held in a rest position by interaction of ratchet tooth 450 with sliding hit member rest peg 484. When projectile slide member 402 slides along tracks 398 and 400 toward end 374, part way up the tracks and just prior to when projectile 44 nears bottom endless belt 52 projectile slide member 402 abuts against sliding hit member 430. Further motion of projectile slide member 402 towards end 374 is now also transferred to sliding hit member 430 moving it along tracks 398 and 400 as projectile slide member 402 moves. After projectile 44 passes under bottom endless belt 52 and as sliding hit member 430 slides along the tracks 398 and 400 first ratchet tooth 452 abuts with end 480 of pawl 468 and depresses end 480 as the ratchet tooth slides over it. If further motion of projectile slide member 402 toward end 374 is stopped as hereinafter described, pawl 468 engages ratchet tooth 462 and consequently will hold sliding hit member 430 at its present position. This position is described as top belt hit position. Assuming that further motion is not inhibited, further sliding of sliding hit member 430 by projectile sliding member 402 will cause ratchet tooth 450 to pass over the end 482 of pawl 468 resulting in pawl 468 engaging ratchet tooth 450. Sliding hit member 430 can now be described as being in the miss position.

Slightly after assuming this miss position projectile sliding member 402 will have reached its end of travel along right cylindrical screw 378 and projectile drive member 410 will be flipped over to interact with left cylindrical screw 380 returning projectile sliding member 402 toward its ready position. While projectile slide member 402 is returning to the ready position sliding hit member 430 is retained in its miss position by pawl 468. When projectile sliding member 402 nears the ready position trip peg 480 meets with and moves stop member 464 which slides sliding trip member 456 causing end 482 of pawl 468 to descend allowing sliding hit member 430 under the influence of spring 488 to return to the position wherein ratchet tooth 450 abuts against sliding hit member rest peg 484.

When trip peg 480 abuts against stop member 464 trip plate contact member 462 also is moved against release arm trip plate 350. Release arm trip plate 350 pivots about pins 352 and pushes against release arm 242 as previously described which ultimately allows shaft 212 to move in an upward direction breaking the contact between spur gear 216 and spur gear 204 which stops rotation of shaft 234 resulting in retention of projectile slide member 402 in its ready position until once again projectile launch button 34 is pushed.

On the extreme right side of shaft 234 after it passes through mounting 310 is a bushing support member 492. Bushing support member 492 is freewheeling upon shaft 234 however, it is maintained upon shaft 234 by a thrust bearing 494 attached to the end of shaft 234. Intermittant mounting 310 and bushing support member 492 on shaft 234 is a pinion 496. Pinion 496 is fixedly attached to shaft 234 and therefore rotates as shaft 234 rotates. In the bushing portion 498 of bushing support member 492 is an axle 500. On one end of axle 500 is a spur gear 502 which meshes with pinion 496 and since it is fixedly attached to axle 500 transfers the rotation of shaft 234 to axle 500. Fixedly attached to the other end of axle 500 is a pinion 504 which rotates in respect to rotation of axle 500. A counter housing 506 which is attached to the bottom of housing 22 by a screw (not shown) has two upstanding ears collectively identified by the numeral 508 attached to it. Mounted in appropriate drillings in ears 508 is an axle 510 having a small pinion 512 and a spur gear 514 fixedly attached to it. Bushing support member 492 pivots about shaft 234 under the influence of gravity such that pinion 504 rests on the top of spur gear 514 and is capable of meshing with and transferring rotation to spur gear 514.

The scoring indicator 38 contains a unit wheel 516 and a tens wheel 518. Each of these wheels are numbered around their circumference from zero to nine allowing for counting of from zero to ninety-nine points. On the right side of unit wheel 516 are spur gear teeth 520, similarly on the right side of tens wheel 518 are spur gear teeth 522. Pinion 512 meshes with spur gear teeth 520 on unit wheel 516 as seen in FIG. 2. Motion from unit wheel 516 is transferred to tens wheel 518 by the interaction of spur gear 524 which is mounted on axle 526 which in turn is mounted in the bottom-most portion of scoring indicator housing 506. In FIG. 17 on the left side of unit wheel 516 is a short rack of gear teeth 528. Spur gear 524 is always in contact with spur gear teeth 522 on tens wheel 518. When unit wheel 516 turns normally there is no interaction with unit wheel 516 and spur gear 524; however, when rack 528 approaches spur gear 524 it contacts spur gear 524 and meshes with it for one tenth of a revolution of unit wheel 516. This can be seen in FIG. 16. When rack 528 meshes with spur gear 524 the rotary motion of unit wheel 516 is transferred to tens wheel 518 and causes tens wheel 518 to advance one tenth of a revolution. This causes the lap counter to successfully count one through nine on the unit wheel and then advances the tens wheel one digit to count from ten to nineteen before advancing the tens wheel a second digit to count from twenty to twenty-nine and so on.

Unit wheel 516 and tens wheel 518 along with knurled knob 530 are mounted on axle 532 within scoring indicator housing 506. Knurled knob 530 has a slotted boss 534 extending toward tens wheel 518 and an indented boss 536 on the other side. Tens wheel 518 contains a key 538 which fits into slotted boss 534 and fixedly attaches knurled knob 530 with respect to rotation of tens wheel 518. A flexible arm 540 extends from scoring indicator housing 506 and has a detent ear 542 on its end. Detent ear 542 meshes with indent boss 536 as seen in FIG. 16 by fitting into any one of ten detents 544 symmetrically spaced about indent boss 536. As the tens wheel 518 is rotated the detent ear 542 tends to retain tens wheel 518 in any one of these positions which serves to center the particular numeral on the tens wheel which is visible on the scoring indicator 38 showing through top 24.

In order to reset both the unit wheel 516 and the tens wheel 518 back to zero at the conclusion of using the toy, as seen in FIG. 16, the interior of the unit wheel 516 acts as a ratchet in that it has one ratchet tooth opening 546. This ratchet tooth opening 546 interacts with pawl 548 which is attached to pawl holding member 550 which fits around bearing 552 of tens wheel 518. Normally during counting the units wheel 516, as shown in FIG. 16, would spin in a clockwise direction and pawl 548 would not interact with the ratchet tooth opening 546. When resetting the scoring indicator 38 to zero the tens wheel 518 is turned clockwise via knurled knob 530 which projects through top 24 and pawl 548 catches in ratchet tooth opening 546 causing the motion of the tens wheel to be transmitted to the units wheel. The ratchet tooth opening 546 and a pin 554 are positioned such that the pawl 548 slips into ratchet tooth opening 546 when the numeral zero on the tens wheel lines up with the numeral zero on the unit wheel.

As viewed in FIG. 3 crown gear 232 rotates in a counterclockwise direction when drum 96 is in the firing position. This causes shaft 234 to rotate in a clockwise direction, left cylindrical screw to rotate in a clockwise direction and right cylindrical screw to rotate in a counterclockwise direction. Consequently pinion 496 (although not shown in FIG. 3) will also rotate in a counterclockwise direction. As noted before pinion 504 rests against spur gear 510 simply because of the weight of bushing support member 492 and the components attached to it. Pinion 496 meshes with spur gear 502, however, since bushing 498 which is part of bushing support member 492 is not fixed in respect to movement in an upward direction, pinion 496 when revolving in a counterclockwise direction tends to impart a counterclockwise momentum to bushing support member 492 and all the components attached thereto such that instead of maintaining intermeshing of the gear teeth and consequently continuation of drive, pinion 504 simply bounces along the surface of spur gear 514.

Contrary to this when pinion 496 rotates in a clockwise direction, (using the same reference points as before) the resulting clockwise momentum imparted to bushing support member 492 holds pinion 504 fixedly against spur gear 514 and causes transfer of rotation of pinion 504 to spur gear 514. When this happens the scoring indicator is activated and motion is transferred to the units wheel and ultimately to the tens wheel as hereinafore described. In summary, counterclockwise rotation of shaft 234 is not transferred to the scoring indicator but clockwise rotation of shaft 234 is transferred to the scoring indicator. Whenever shaft 234 is thus rotated in a clockwise direction points are accumulated on the scoring indicator.

As shown in FIG. 2 located near the bottom of housing 22 is a battery housing 556 containing batteries collectively identified by the numeral 558. Positioned over battery housing 556 are two electrical contacts 560 and 562. Contact 560 is fixed within the housing 22 and the contact 562 is directly connected to off and on switch 32. When off and on switch 32 is pushed to the on position a circuit is completed between electrical contacts 560 and 562.

As shown in FIG. 3 placed adjacent to cam 114 is an electrical contact 564 which fits against the surface of cam 114 and is moved by cam 114 as cam 114 rotates in respect to rotation of shaft 110. Positioned adjacent to electrical contact 564 is a stationary electrical contact 566 mounted on the side of motor gear housing 86. As cam 114 rotates the motion of its cam surfaces against electrical contact 564 causes electrical contact 564 to alternately make electrical contact with stationary contact 566 and make and break electrical contact with contact 566.

FIG. 18 shows the wiring between all of the electrical components of the toy. When the off and on switch 32 is closed the circuit between contacts 560 and 562 is closed completing an electrical circuit between batteries 558, motor 84 and timer contacts 142 and 140. If the pointer 46 of the timer 38 is positioned between the F and S marking on top 24 as previously described, contact 140 is positioned in notch 138 and the circuit through timer 28 is not complete. By manually turning knurled knob 30 as previously described the notch 138 is advanced completing the electrical circuit through the timer 28. This starts motor 84 rotating and its motion is transferred to the timer 28 through the appropriate gears as previously described. The motor 84 will continue running until either the notch 138 in timer 28 advances until it is once again positioned under contact 140 or the circuit is broken between contacts 560 and 562 of off and on switch 32.

Wired in parallel with motor 84 from junction point 568 to junction point 570 is a circuit which includes electrical contact 296, metal contact surface 292, electrical contact 294, electrical contact strip 418, spring electrical contact 420, light 422, sliding electrical contact 424 and elongated electrical contact strip 428. This circuit is closed lighting lamp 422 when spring electrical contact 420 touches elongated contact strip 418. As previously noted this happens when the projectile launch button 34 is depressed which results in shaft 234 spinning counterclockwise causing cam surface 396 on left cylindrical screw 380 to push the projectile drive member 410 against right cylindrical screw 378 and spring contact 420 against elongated contact strip 418. This contact is maintained as the projectile drive member 410 is driven towards ends 374. The contact is broken when the cam surface 394 on the right cylindrical screw 378 pushes the projectile drive member 410 toward the left cylindrical screw 380. Thus the projectile 44 is lighted by light 422 only when it is traveling toward the objects 42.

As the projectile drive member 410 goes up the track members 398 and 400 it mates with and slides sliding hit member 430. Both sliding hit member 430 and projectile drive member 410 go underneath the top surface of the endless belts 50 and 52. When the projectile 44 is underneath bottom endless belt 52 such that an object 42 on bottom endless belt 52 is centered directly over projectile 44 hit contact 442 makes electrical contact with bottom endless belt contact 444 because the object 42 and the projectile 44 have the same y coordinate point. If at the same time the projectile 44 and the object 42 also have the same x coordinate electrical contact is also made between spring electrical contact 80 and contact strip 74. Meanwhile sliding contact 440 on sliding hit member 430 has been in continuous contact with elongated electrical contact strip 428. The simultaneous contact between contacts 74 and 80 and contacts 442 and 444 completes the circuit through the solenoid 250 between junction point 572 and 570. This circuit is parallel to the circuit through the motor in respect to the same junction points.

A similar circuit could be completed through the solenoid if hit contact 442 made electrical contact with top endless belt contact 446 at the same time that spring contact 78 made contact with contact 72. This would happen if the projectile 44 assumed a position with an object 42 on the top endless belt 50 wherein both the projectile 44 and the object 42 had the same x and y coordinate points.

If when the projectile 44 passes under either of the endless belts 50 or 52 such that it is either in front of or behind a particular object 42 it would not have the same x coordinate point as the object and thus even though the contact is made between hit contact 442 and the bottom and top endless belt contacts 444 or 446 the circuit through the solenoid 250 would not be complete because the appropriate contact between spring electrical contacts 80 or 78 would not be made with contacts 74 or 72. Likewise even though the projectile 44 may be lined up along the x coordinate with the object 42 while it is traveling toward that object if it is not directly on center with respect to the y coordinate the appropriate contact between hit contact 442 and the endless belts contact 444 and 446 will not be made simultaneously with the contact between spring contacts 80 and 78 and the respective contacts 74 and 72.

When the projectile 44 misses an object the projectile drive member 410 travels all the way up right cylindrical screw 378. The projectile drive member 410 is switched to the left cylindrical screw member 380 disrupting the circuit to light 422 and the projectile 44 returns to its ready position in an unlighted and therefore unseen state. Trip plate contact member 462 then hits release arm 350 which disengages the drive to shaft 234 as previously described. The projectile 44 is now ready to be fired again at the objects 42 by once again depressing the projectile launch button 34.

If, however, the projectile 44 and an object 42 do assume the same x and y coordinate points closing the circuit to solenoid 250, solenoid 250 magnetically pulls metal plate 254 toward it freeing detent finger 262 from bottom ratchet tooth 266 which allows drum 96 to spin until top ratchet tooth 268 catches the detent finger 262. This switches metal contact surface 292 from the firing position to the hit position and closes the circuit between contacts 296 and 298. Meanwhile cam 114 is opening and closing this same circuit through contacts 564 and 566. This establishes an intermittant circuit from junction point 568 through light 436 to junction point 570. Light 436 flashes with respect to movement of cam 114. Simultaneously with establishing this circuit, because drum 96 is in the hit position, crown gear 232 and consequently shaft 234 have reversed directions and are now spinning counterclockwise. This counterclockwise motion causes scoring indicator 38 to be activated and a set of points are accumulated on the scoring indicator depending upon whether the hit was made with an object on the bottom endless belt 52 or the top endless belt 50.

Since projectile drive member 410 must travel the full length of right cylindrical screw 378 before it is pushed over toward left cylindrical screw member 380 and since hit contact 442 will make contact with either bottom endless belt contact 444 or top endless belt contact 446 when the projectile drive member 410 is still in contact with right cylindrical screw 378, whenever a hit is established, be it on the bottom endless belt or the top endless belt, the projectile drive member 410 is always in drive contact with right cylindrical screw 378. When a hit is made shaft 234 reverses direction as previously explained and aside from operating the scoring indicator 38 this reversal of direction causes both the right and left cylindrical screws 378 and 380 to also reverse direction.

When the right cylindrical screw 378 reverses direction instead of driving projectile drive member 410 toward end 374 it drives it toward end 302. If the hit is made on the bottom endless belt 52 the projectile drive member 410 will only be part way up the right cylindrical screw 378. If the hit is made on top endless belt 50 the projectile drive member 410 will be further up the right cylindrical screw 378. As a result of the different placement of projectile drive member 410 it takes the projectile drive member 410 longer (more counterclockwise rovolutions of right cylindrical screw 378) to return from a hit on an object on the top endless belt 50 to its ready position than it will when the hit is made on the bottom endless belt 52. For this reason the scoring indicator 38 will be activated for a longer period of time when a hit is made on top endless belt compared to a hit made on the bottom endless belt. As a result of this more points are accumulated for a hit on the top endless belt compared to a hit made on the bottom endless belt. Normally the gearing is set up such that a hit on the top endless belt will result in five points and a hit on the bottom endless belt will result in three points.

Since when a hit is made drum 96 and consequently metal disc 292 rotate, the circuit to light 422 which illuminates the projectile is broken and the projectile is not lit up as the projectile drive member 410 returns down the right cylindrical screw 378 even though contact is still maintained between spring electrical contact 420 and elongated electrical contact strip 428. Also as long as the drum 96 remains in the hit position the clicker spur gear 196 spins against the clicker arm 198 and the toy emits a noise during the time it takes for the projectile drive member 410 to travel down the right cylindrical screw 378.

When the projectile drive member 410 is completely returned down the right cylindrical screw 378 trip peg 480 abuts against stop member 464 which causes trip plate contact member 462 to make contact with and move release trip arm plate 350. The motion of release arm trip plate 350 is transferred to release arm 242 of three armed member 236. This swivels three armed member 236 about shaft 234 such that lock arm 238 and solonoid trip arm 240 are both moved. As previously noted lock arm 238 releases shaft 212 disengaging spur gear 216 from spur gear 204 stopping the rotation of shaft 234 which in turn ceases the accumulation of points on the scoring indicator 38 and also stops movement of the projectile slide member 402. Movement of solenoid trip arm 240 in turn ultimately results in drum 94 rotating back from the hit position to the firing position.

As can be seen in FIGS. 2 and 12 when the sliding hit member 430 is at its closest point of travel toward end 302 the sliding hit member 430 is held in a position underneath bottom endless belt 52 by the interaction of sliding hit rest peg 484 and ratchet tooth 450. When projectile sliding member 402 abuts against it it moves from this position. After a hit is scored on an object 42 on bottom endless belt 52, projectile sliding member 402 starts to travel back down right cylindrical screw 378. Sliding hit member 430 travels with projectile slide member 402 from its position wherein hit contact 442 made contact with bottom endless belt contact 444 to its position wherein ratchet tooth 450 abuts against sliding hit peg 484. This in effect repositions hit indicator light 436 underneath the object 42 on bottom endless belt 52. When a hit is scored on an object 42 on top endless belt 50 sliding hit member 430 is positioned underneath top endless belt 50 but slightly displaced toward end 374. As the projectile sliding member 402 travels back down right cylindrical screw 378 sliding hit member 430 is returned to a position centered underneath top endless belt 50 and is maintained there by interaction of pawl 468 with ratchet tooth 452. This centers hit indicator light 436 underneath the object 42 on top endless belt 50. As the hit indicator light 436 flashes indicating a hit, its position underneath an object 42 on either the top endless belt 50 or the bottom endless belt 52 gives the visual effect that that particular object has been hit by the projectile 44.

If a hit has not been scored, the projectile 44 misses all of the objects 42 and the sliding hit member 430 travels to and is retained in its miss position by the interaction of pawl 468 with ratchet tooth 450. This holds the sliding hit member 430 in place so that the bias of spring 488 is not transferred via sliding hit member 430 to the projectile sliding member 402. This allows the projectile drive member 410 to freely swing through the free space at the end of elongated partition member 392. If the sliding hit member 430 were not retained by the interaction of pawl 468 and ratchet tooth 450 the bias of spring 488 would pull sliding hit member 430 against projectile sliding member 402 and might cause projectile drive member 410 to jam against the end of elongated partition member 392.

I claim:

1. A toy which comprises:

a support structure;

an object means serving as a target;

an object means positioning means located on said support structure, said object means positioned on said object means positioning means permitting said object means to move along the x coordinate of an x, y, z coordinate system;

a projectile means capable of attacking said object means;

projectile means positioning means positioning said projectile means on said support structure permitting said projectile means to move along the x and y coordinates of an x, y, z coordinate system;

said object means and said projectile means capable of assuming an interference position wherein both said object means and said projectile means have substantially the same x and y coordinate points but different z coordinate points;

detection means for detecting when said object means and said projectile means are in said interference position;

projectile drive means for moving said projectile means along the x coordinate of an x, y, z coordinate system, said projectile drive means including a rotating drive capable of rotating in a first direction and reversing and rotating in a second direction, said rotating drive rotating in said first direction when said projectile means is attacking said object means to drive said projectile from a ready position toward said object means and responsive to said projectile means and said object means not being in said interference position returning said projectile to said ready position, said rotating drive reversing direction of rotation and rotating in said second direction in response to said projectile means and said object means being in said interference position to return said projectile means to said ready position.

2. The toy of claim 1 including:

object drive means for moving said object means along the x coordinate of an x, y, z coordinate system.

3. The toy of claim 2 wherein:

said object drive means and said projectile drive means include a motor means independently operatively connected to both said object drive means and said projectile drive means.

4. The toy of claim 3 including:

operator control means for controlling the movement of said projectile means along the x coordinate of an x, y, z coordinate system;

said operator control means including a steering means movable in response to stimulus from an operator of said toy.

5. The toy of claim 1 wherein:

said detection means includes a signaling means for signaling when said object means and said projectile means are in said interference position.

6. The toy of claim 5 wherein:

said detection means includes a scoring means for accumulating the number of times said object means and said projectile means are in said interference position.

7. The toy of claim 4 wherein:

said detection means includes a signal means for signaling when said object means and said projectile means are in said interference position;

said detection means including a scoring means for accumulating the number of times said object means and said projectile means are in said interference position.

8. A toy which comprises:

a support structure;

at least one object member movably supported on said support structure, said object member moving along a pathway on said support structure;

a projectile member movably supported on said support structure, said projectile member capable of moving in a first direction essentially perpendicular to and across said object member pathway and in a second direction essentially parallel to said object member pathway;

at least one interference position between said object member and said projectile member wherein said object member and said projectile member overlay each other;

detection means for detecting said interference position;

said detection means including an independent parallel coordinate detecting component and an independent perpendicular coordinate detecting component;

said parallel coordinate detecting component detecting the position of said projectile with respect to said object member in a direction parallel to the direction of travel of said object member about said pathway on said support structure;

said perpendicular coordinate detecting component detecting the position of said projectile with respect to said object member in a direction perpendicular to the direction of travel of said object member about said pathway on said support structure.

9. The toy of claim 8 including:

said object member located on an orbiting member;

an orbiting member support means mounted on said support structure;

said orbiting member movably mounted on said orbiting member support means permitting said orbiting member to orbit about said orbiting member support means;

orbiting member drive means for orbiting said orbiting member about said orbiting member support means;

projectile member mounting means mounted on said support structure;

said projectile member movably mounted on said projectile member mounting means;

projectile member moving means for moving said projectile on said projectile member mounting means;

a motor means mounted on said support structure;

said motor means independently operatively connected to said orbiting member drive means and to said projectile member moving means, said motor means orbiting said orbiting member about said orbiting member support means and moving said projectile member in said first direction.

10. The toy of claim 9 wherein:

said detection means include orbiting member drive means disconnection means for temporarily interrupting said orbiting member drive means from orbiting said orbiting member;

scoring means for accumulating the total number of times said object means and said projectile means are in said interference position.

11. The toy of claim 10 wherein:

said orbiting member includes at least one orbiting endless belt;

a plurality of object members located on said orbiting endless belt;

said orbiting member support means includes endless belt mounting means, said endless belt mounting means attaching to said support member;

said projectile member moving means includes an operator activated steering member operatively connecting to said projectile member and moving said projectile member in said second direction.

12. The toy of claim 11 including:

two endless belts;

each of said endless belts independently mounted on said endless belt mounting means, each of said endless belts independently orbiting around said endless belt mounting means;

a portion of said plurality of said objects located on one of said endless belts, the remaining portion of said plurality of said objects located on the other of said belts.

13. A toy which comprises:

a support structure;

at least one object member movably supported on said support structure, said object member moving along a pathway on said support structure;

a projectile member movably supported on said support structure, said projectile member capable of moving in a first direction essentially perpendicular to and across said object member pathway and in a second direction essentially parallel to said object member pathway;

at least one interference position between said object member and said projectile member wherein said object member and said projectile member overlay each other;

detection means for detecting said interference position;

said detection means include orbiting member drive means disconnection means for temporarily interrupting said orbiting member drive means from orbiting said orbiting member;

said object member located on an orbiting member;

an orbiting member support means mounted on said support structure;

said orbiting member movably mounted on said orbiting member support means permitting said orbiting member to orbit about said orbiting member support means;

orbiting member drive means for orbiting said orbiting member about said orbiting member support means;

projectile member mounting means mounted on said support structure;

said projectile member movably mounted on said projectile member mounting means;

projectile member moving means for moving said projectile on said projectile member mounting means;

a motor means mounted on said support structure;

said motor means independently operatively connected to said orbiting member drive means and to said projectile member moving means, said motor means orbiting said orbiting member about said orbiting member support means and moving said projectile member in said first direction;

scoring means for accumulating the total number of times said object means and said projectile means are in said interference position;

said orbiting member includes two orbiting endless belts;

a plurality of object members located on said orbiting endless belt;

said orbiting member support means includes endless belt mounting means, said endless belt mounting means attaching to said support member;

said projectile member moving means includes an operator activated steering member operatively connecting to said projectile member and moving said projectile member in said second direction;

each of said endless belts independently mounted on said endless belt mounting means, each of said endless belts independently orbiting around said endless belt mounting means;

a portion of said plurality of said objects located on one of said endless belts, the remaining portion of said plurality of objects located on the other of said belts;

one of said endless belts orbiting in a first direction and the second of said endless belts orbiting in an opposite direction such that said portion of said objects located on one of said endless belts travels in one direction and said remaining portions of said objects on said other endless belt travel in a second direction, said first direction parallel to but opposite to said second direction.

14. The toy of claim 13 including:

a projectile member activating means for activating movement of said projectile toward said objects in said first direction;

said projectile member activating means connecting said motor means to said projectile member moving means when said projectile member activating means is activated.

15. A toy which comprises:

a support member;

at least one endless belt, an endless belt mounting member mounted on said support member, said endless belt mounted on said endless belt mounting member and orbiting about said endless belt mounting member;

a plurality of objects, said plurality of objects located on the surface of said endless belt and orbiting about said endless belt mounting member as said endless belt orbits said endless belt mounting member;

a projectile housing member slidably mounted on said support member and capable of moving on said support member in a direction which is parallel to the direction of travel of said objects about said endless belt support member;

a projectile, said projectile mounted on said projectile housing member and moving with said projectile housing member in a direction that is perpendicular to the direction of travel of said objects about said endless belt support member;

an endless belt drive means driving said endless belt about said endless belt mounting member;

a projectile drive means driving said projectile on said projectile housing member;

a drive motor, said drive motor independently operatively connected to said endless belt drive means and said projectile drive means;

said projectile capable of independently assuming an interference position with each of said pluralities of objects;

an interference position detecting means for detecting said interference position between said projectile and any of said plurality of objects;

a signaling means for signaling when said interference position detecting means detects said interference position.

16. The toy of claim 15 including:

a projectile sliding member slidably mounted on said projectile housing member and sliding on said projectile housing member in a direction which is perpendicular to the direction of travel of said objects about said endless belt support members;

said projectile mounted on said projectile sliding member;

said projectile drive means operatively connected to said projectile sliding member sliding said projectile sliding member on said projectile housing member;

a projectile housing member moving means operatively connected to said projectile housing member and moving said projectile housing member on said support member in a direction which is parallel to the direction of travel of said objects about said endless belt support member.

17. The toy of claim 16 including:

a portion of said projectile housing member located within the interior of said endless belts such that said projectile sliding member can slide within the interior of said endless belt locating said projectile below each of said objects;

said interference position including said projectile located beneath any one of said objects.

18. The toy of claim 17 wherein:

said interference position detecting means includes a parallel coordinate detecting component and a perpendicular coordinate detecting component;

said parallel coordinate detecting component detecting the position of said projectile with respect to any one of said objects in a direction parallel to the direction of travel of said objects about said endless belt support member;

said perpendicular coordinate detecting components detecting the position of said projectile with respect to any one of said objects in a direction perpendicular to the direction of travel of said object about said endless belt support member.

19. The toy of claim 18 wherein:

said interference detecting means includes said endless belt having a plurality of slots, said plurality of slots equal in number to the number of said plurality of objects, each one of said slots corresponding to one of said objects;

a first electrical contact member lying next to said endless belt on one side of said endless belt;

a second electrical contact member lying next to the other side of said endless belt, said second electrical contact member capable of passing through each of said slots and making an electrical contact with said first electrical contact;

said electrical contact between said first and said second electrical contacts occuring when said projectile and one of said objects both lie on a line which is perpendicular to said direction of travel of said objects about said endless belt support member.

20. The toy of claim 19 including:

a sliding hit member slidably mounted on said projectile housing member and sliding on said projectile housing member in a direction which is perpendicular to the direction of movement of said objects about said endless belt support member, said sliding hit member capable of sliding within the interior of said endless belts.

21. The toy of claim 20 including:

an endless belt electrical contact, said endless belt electrical contact mounted on said projectile housing member;

said sliding hit member including a hit electrical contact, said hit electrical contact sliding on said projectile housing member and including one position wherein said hit electrical contact makes electrical contact with said endless belt electrical contact;

said electrical contact between said hit electrical contact and said endless belt electrical contact occuring when said projectile and one of said objects both lie on a line which is colinear with the direction of travel of said objects about said endless belt support member.

22. The toy of claim 21 including:

a sliding housing slidably mounted on said support members, said sliding housing located below said endless belts and operatively connected to said projectile housing member such that when said projectile housing member moves in the direction which is perpendicular to the direction of travel of said objects about said endless belt support member said sliding housing also moves in the direction which is perpendicular to the direction of travel of said objects about said endless belt support member but 180 degrees out of phase with said projectile housing member.

23. The toy of claim 22 wherein:

said second electrical contact member is mounted on said sliding housing such that as said sliding housing slides said second electrical contact member also slides and when said projectile and any one of said objects both lie on a line which is perpendicular to said direction of travel of said objects about said endless belt support member said second electrical contact member passes through the slot corresponding to said object.

24. The toy of claim 23 including:

two endless belts, a first endless belt and a second endless belt, each independently mounted on said endless belt mounting member and each independently connected to said endless belt drive means;

a portion of said plurality of said objects located on said first endless belt and the remaining portion of said plurality of said objects located on said second endless belt.

25. The toy of claim 24 including:

each of said first and second endless belts having a plurality of slots, the plurality of slots on each endless belt equal in number to the number of objects on each endless belt;

two first electrical contact members, one lying next to said first endless belt on one side of said first endless belt, the other lying next to said second endless belt on one side of said second endless belt;

two second electrical contact members, one lying next to the underside of said first endless belt the other lying next to the underside of said second endless belt;

a first and a second endless belt electrical contact, both of said first and said second electrical endless belt contacts mounted on said projectile housing member;

said hit member making an electrical contact with said first endless belt electrical contact when said projectile and one of said objects on said first endless belt both lie on a line which is colinear with the direction of travel of said objects about said endless belt support member, said hit electrical contact making a electrical contact with said second endless belt electrical contact when said projectile and one of said objects on said second endless belt both lie on a line which is colinear with the direction of travel of said objects about said endless belt support member.

26. The toy of claim 25 wherein:

said signaling means includes a flashing light means mounted on said sliding hit member.

27. The toy of claim 26 including:

a scoring means for accumulating the number of times said projectile means is in an interference position with any of said object means.

28. The toy of claim 27 wherein:

said scoring means accumulates a first increment of scoring points when said projectile assumes an interference position with an object on said first endless belt and a second increment of scoring points when said projectile assumes an interference position with an object on said second endless belt.

29. The toy of claims 15 or 28 including:

a timer means defining an increment of time for operating the toy.

30. A toy which comprises:

a support structure;

at least one object member movably supported on said support structure, said object member moving along a pathway on said support structure;

a projectile member movably supported on said support structure, said projectile member capable of moving in a first direction essentially perpendicular to and across said object member pathway and in a second direction essentially parallel to said object member pathway;

at least one interference position between said object member and said projectile member wherein said object member and said projectile member overlay each other;

detection means for detecting said interference position;

said orbiting member includes at least one orbiting endless belt;

a plurality of object members located on said orbiting endless belt;

said orbiting member support means includes endless belt mounting means, said endless belt mounting means attaching to said support member;

said interference detecting means includes said endless belt having a plurality of slots, said plurality of slots equal in number to the number of said plurality of objects, each one of said slots corresponding to one of said objects;

a first electrical contact member lying next to said endless belt on one side of said endless belt;

a second electrical contact member lying next to the other side of said endless belt, said second electrical contact member capable of passing through each of said slots and making an electrical contact with said first electrical contact;

said electrical contact between said first and said second electrical contacts occuring when said projectile and one of said objects both lie on a line which is perpendicular to said direction of travel of said objects about said endless belt support member.

* * * * *